US007779657B2

(12) United States Patent
Yu

(10) Patent No.: US 7,779,657 B2
(45) Date of Patent: Aug. 24, 2010

(54) LOCK HAVING AN INDICATIVE LOCK CORE

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 12/230,718

(22) Filed: Sep. 4, 2008

(65) Prior Publication Data

US 2009/0007605 A1 Jan. 8, 2009

Related U.S. Application Data

(62) Division of application No. 12/213,031, filed on Jun. 13, 2008.

(30) Foreign Application Priority Data

Jun. 14, 2007 (TW) ..... 96121600 A

(51) Int. Cl.
*E05B 37/02* (2006.01)

(52) U.S. Cl. ..... 70/21; 70/25; 70/38 C; 70/284; 70/285

(58) Field of Classification Search ..... 70/21, 70/25, 26, 38 A, 38 C, 284, 285, DIG. 63, 70/DIG. 71
See application file for complete search history.

(56) References Cited

U.S. PATENT DOCUMENTS 983,637 A * 2/1911 Murphy ..... 70/38 R
1,597,560 A * 8/1926 Wise ..... 70/38 R
2,496,320 A * 2/1950 Viekers ..... 70/38 C
4,751,830 A 6/1988 Cheng
6,539,761 B2 4/2003 Yang
6,877,345 B1 4/2005 Misner et al.
7,121,123 B2 * 10/2006 Yu ..... 70/21
7,293,439 B1 * 11/2007 Miao ..... 70/21
7,523,628 B2 * 4/2009 Yu ..... 70/21
2005/0034492 A1 * 2/2005 Yu ..... 70/25
2005/0039500 A1 * 2/2005 Yu ..... 70/25
2006/0027000 A1 * 2/2006 Yu ..... 70/21
2006/0266084 A1 * 11/2006 Kuo et al. ..... 70/21
2007/0271969 A9 * 11/2007 Yu et al. ..... 70/25
2007/0289343 A1 * 12/2007 Yu et al. ..... 70/21
2008/0000274 A1 * 1/2008 Yu ..... 70/21
2008/0098774 A1 * 5/2008 Huang ..... 70/21

* cited by examiner

*Primary Examiner*—Lloyd A Gall
(74) *Attorney, Agent, or Firm*—Rosenberg, Klein & Lee

(57) ABSTRACT

A lock includes a housing, a shackle, a controlling unit and a lock core. The shackle has a root section and a free section. The root section is disposed in the housing. The free section extends from the root section and is disposed outside the housing. The controlling unit is disposed in the housing and connected to the root section of the shackle. In particular, the controlling unit is capable of rotating about the root section and axially moving with the root section. Additionally, the lock core is disposed in the housing and is configured to control rotation of the controlling unit.

2 Claims, 26 Drawing Sheets

LOCK HAVING AN INDICATIVE LOCK CORE

CROSS REFERENCE TO RELATED APPLICATION

This is a division of co-pending application Ser. No. 12/213,031, filed on Jun. 13, 2008.

BACKGROUND OF INVENTION

1. Field of Invention

This invention relates to a lock, and more particularly to a lock including an indicative lock core adapted both to lock/unlock the lock and to indicate whether the lock has been unlocked.

2. Related Prior Art

U.S. Pat. No. 6,877,345 and U.S. Pat. Pub. No.: 2005/0262902A1 each shows a lock including an indicator therein. The indicator is capable of being driven by a key-operated lock core of the lock to move to an indicative position, whereby it indicates to a user whether the key-operated lock core of the lock has been operated. However, the indicator occupies some of the space inside the lock and is also correlated with an increase in structural complexity.

SUMMARY OF INVENTION

This invention relates to a lock including a housing and an indicative lock core. The indicative lock core is configured to be activated by a key in order to lock/unlock the lock and to indicate whether the indicative lock core of the lock has been operated as to unlock the lock.

The indicative lock core includes a spindle. The spindle defines a keyhole for receiving the key.

Preferably, the indicative lock core is configured in a way that the spindle moves to an indicative position when the key is taken out from the keyhole.

Preferably, the indicative lock core is configured in a way that the spindle moves to the indicative position when the key is inserted into the keyhole.

Preferably, the indicative lock core is configured in a way that the spindle moves to the indicative position when the key drives the spindle to rotate.

In any case, when the spindle is in the indicative position, the spindle is partly situated outside the housing in order to demonstrate that the indicative lock core has been operated.

DETAILED DESCRIPTION OF EMBODIMENTS

Figure 1:
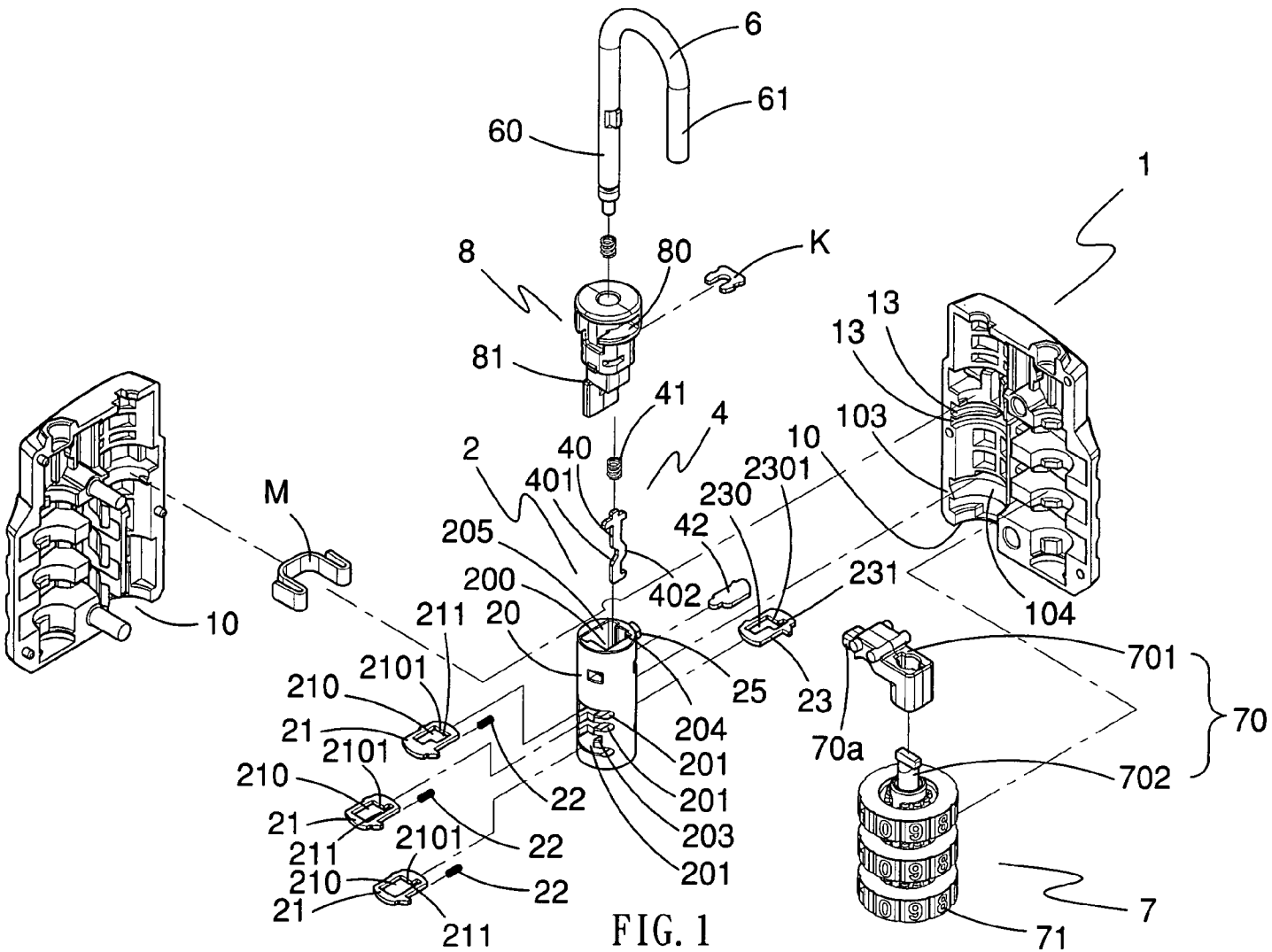
FIG. 1 is an exploded view of a padlock according to a first embodiment of the present invention.
Figure 2:
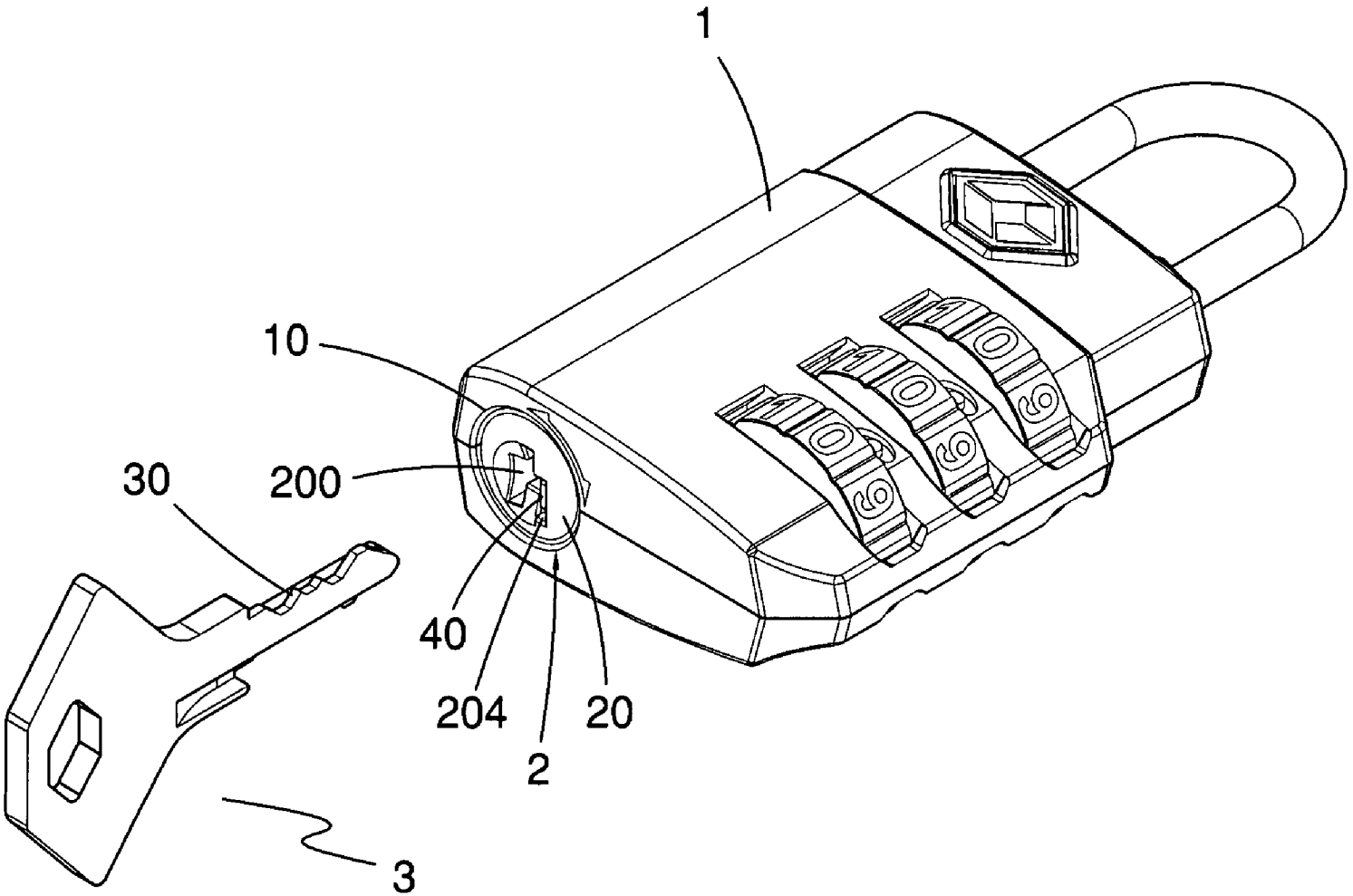
FIG. 2 is a perspective view illustrating an assembled padlock of FIG. 1 and a key.

Referring now to FIGS. 1 and 2 of the drawings, a lock in accordance with a first embodiment of the invention includes a housing 1 and an indicative lock core 2. The housing 1 is composed of two half-shells and the two half-shells together define an opening 10 in a bottom. The indicative lock core 2 is disposed in the housing 1 and includes a spindle 20, a plurality of latch plates 21 and a plurality of springs 22.

The spindle 20 has a cylindrical shape and is normally received in the housing 1 with its end received in the opening 10. The spindle 20 is formed with a protrusion 25 on a side and defines a keyhole 200 therein and a plurality of latch slots 201 parallel to one another. The keyhole 200 is configured to receive teeth 30 of a key 3 which is mated with the indicative lock core 2. These latch slots 201 are vertically interconnected with the keyhole 200. These latch plates 21 together with the corresponding springs 22 are assembled in the latch slots 201 respectively. The latch plates 21 are biased by the springs 22 respectively in such a way that the latch plates 21 are normally partly situated outside the latch slots 201. In other situations, those latch plates 21 may bounce out of or draw back to the latch slots 201 as a result of the flexibility of the springs 22. In contrast, no spring abuts the blocking plate 23 so that the blocking plate 23 is freely received in the blocking slot 203.

Each of the latch plates 21 defines a hole 210 therein. When each latch plate 21 is assembled in the respective latch slot 201, the holes 210 are in alignment/communication with the keyhole 200. Inner plateaus 2101 of the holes 210 of the latch plates 21 are located in different height levels, some higher, some lower, and no two ones are situated in the same level, and that depends on shape of the teeth 30 of the key 3.

Figure 3:
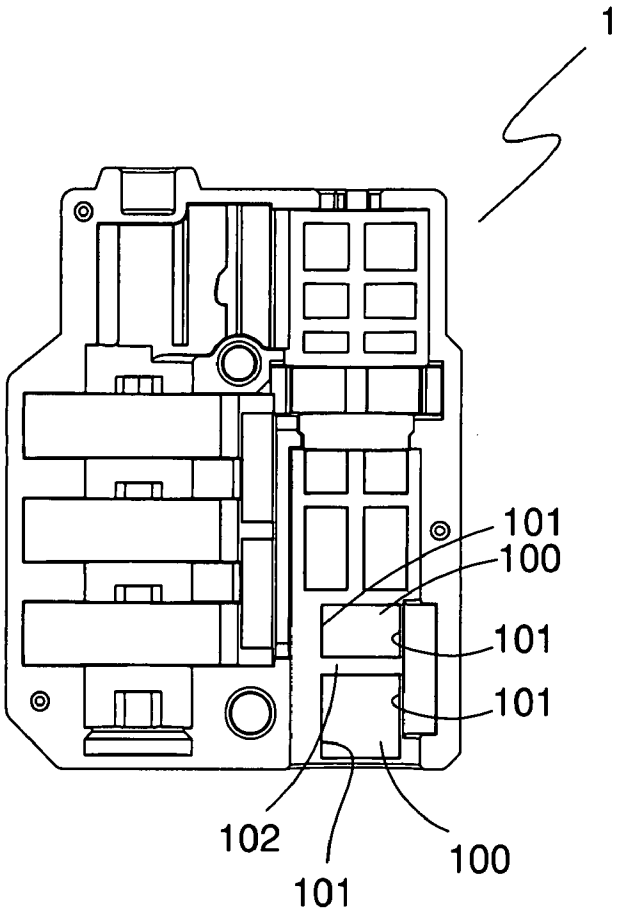
FIG. 3 is a perspective view of one half-shell of the padlock of FIG. 1.
Figure 5:
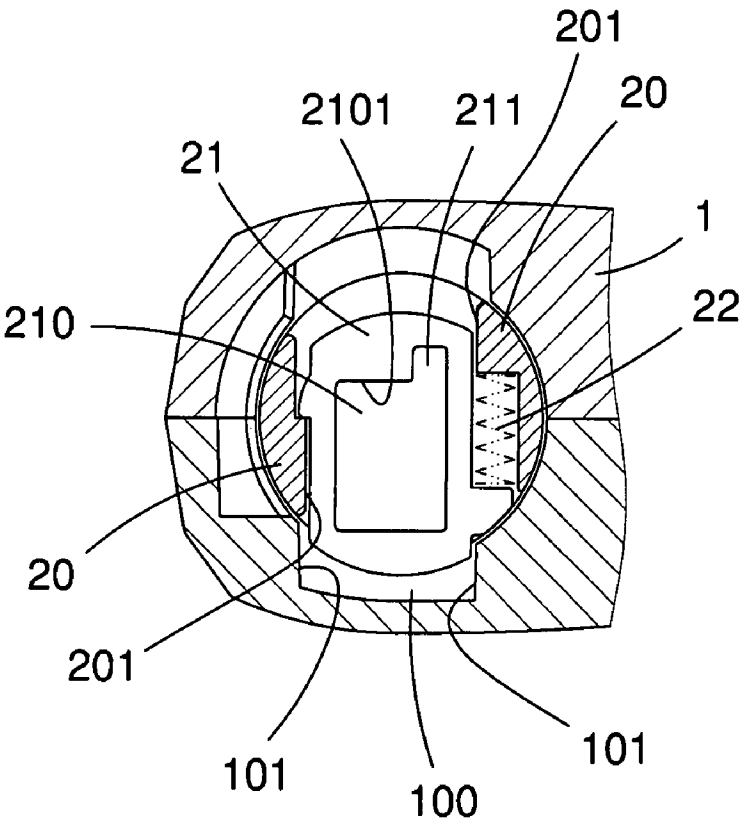
FIG. 5 is a fragmentary cross-sectional view illustrating an indicative lock core and a housing of the padlock of FIG. 2.
Figure 6:
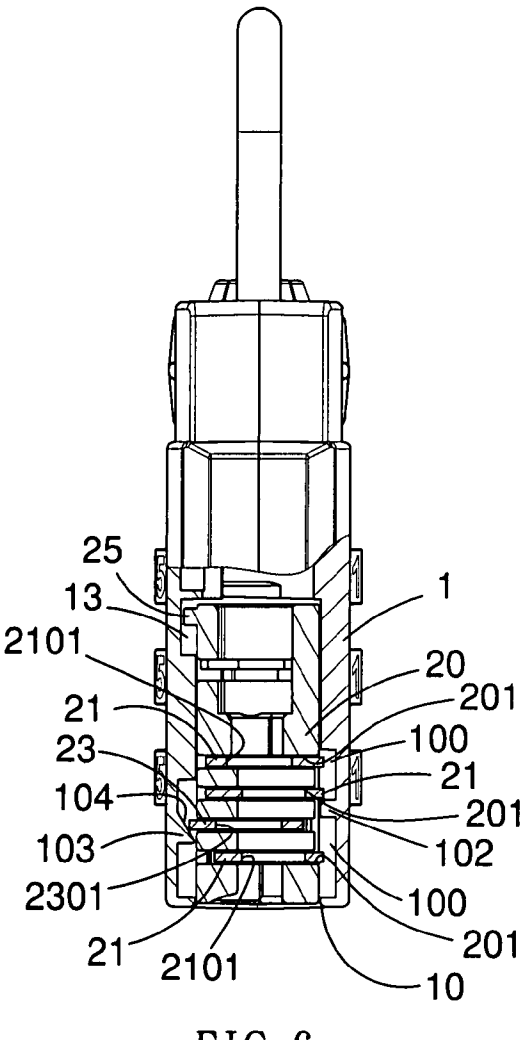
FIG. 6 is a side view, partially broken away to show details of construction, of the padlock of FIG. 2.

As shown in FIGS. 1 and 3, the housing 1 defines a room 100 corresponding to the latch plates 21 and has a ridge 102 dividing the room 100 into an upper section and a lower section. As shown in FIGS. 5 and 6, the latch plates 21 are mostly received in the latch slots 201 of the spindle 20 and partly exposed outside the spindle 20. Those exposed portions of the latch plates 21 are received in the room 100 and are confined by opposed side walls 101 of the room 100 in such a way that the spindle 20 is not allowed to rotate. In addition, as shown in FIG. 6, since at least one latch plate 21 is blocked by the ridge 102, the spindle 20 is not allowed to move linearly in a direction toward the opening 10 either.

As shown in FIG. 1, the indicative lock core 2 further includes a blocking plate 23. The spindle 20 further defines a blocking slot 203 for receiving the blocking plate 23. The blocking slot 203 is in parallel with those latch slots 201 and vertically interconnected with the keyhole 200. The blocking plate 23 defines a hole 230. When the blocking plate 23 is assembled in the blocking slot 203, the hole 230 is in alignment/communication with the keyhole 200. An inner plateau 2301 of the hole 230 and the inner plateaus 2101 of the latch plate 21 are located on the same side.

Figure 4:
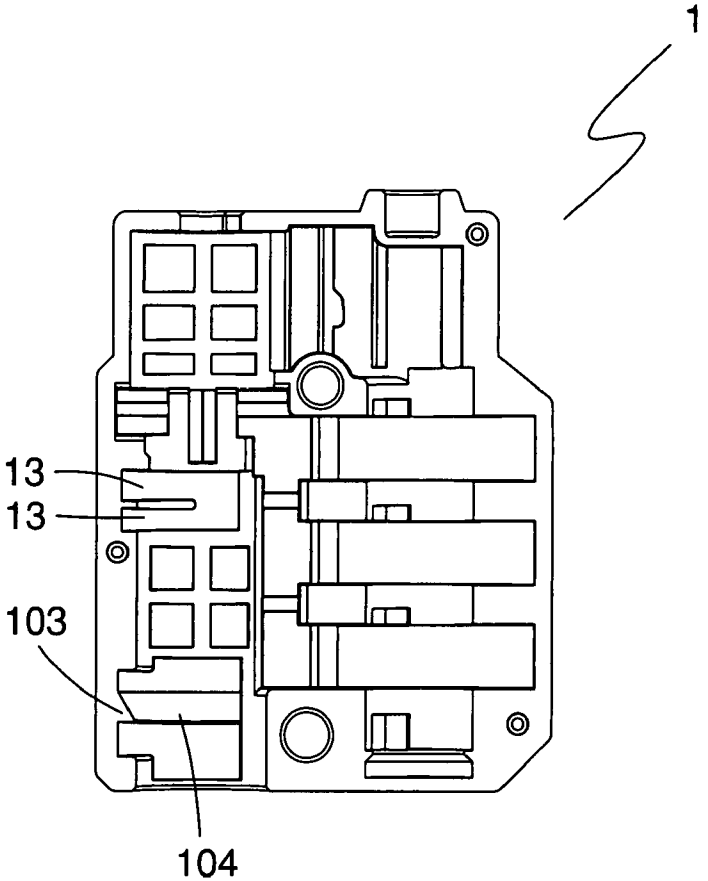
FIG. 4 is a perspective view of the other half-shell of the padlock of FIG. 1.

As shown in FIGS. 1 and 4, the housing 1 has a rib 103 corresponding to the blocking plate 23. The rib 103 has an incline 104.

Figure 7:
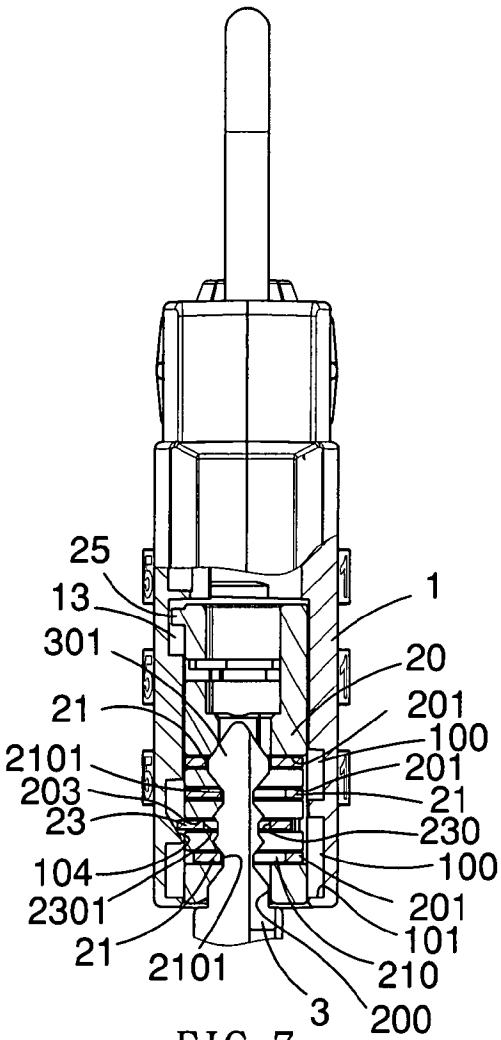
FIG. 7 is similar to FIG. 6, showing that the key is inserted into the padlock and the spindle of the padlock is allowed to be rotated.

As shown in FIG. 7, when the key 3 is inserted into the keyhole 200 and passes through all the holes 210 of the latch plates 21 and the hole 230 of the blocking plate 23, the latch plates 21 retract into the latch slots 201 from the room 100 of the housing 1 as a result of the inner plateaus 2101 of the latch plates 21 being pressed by the teeth 30 of the key 30. That is, the latch plates 21 are no more confined by the two opposite side walls 101 of the room 100. At this time, the spindle 20 is allowed to be rotated by the key 3 in order to unlock the lock.

Likewise, when the key 3 is inserted into the keyhole 200, the plateau 2301 of the blocking plate 23 is pushed by the teeth 30 to have the blocking plate 23 partly situated outside the blocking slot 203. Specifically, the teeth 30 have a highest awl-shaped protrusion 301. The plateau 2301 of the blocking plate 23 is pushed aside by the passing highest awl-shaped protrusion 301 when the key 3 is inserted into the keyhole 200.

After being rotated by the key to unlock the lock, the spindle 20 can then be rotated reversely back to its original position by reverse operation of the key. When the spindle 20 is rotated to its original position via the key 3, the key 3 is allowed to be removed from the keyhole 200 of the spindle 20 so as to have each latch plates 21 be restored to its original state where each latch plates 21 is biased by the spring 22 and partly received in the room 100. At this time, the blocking plate 23 remains partly situated outside the blocking slot 203 and abutting against the incline 104 of the housing 1.

Figure 9:
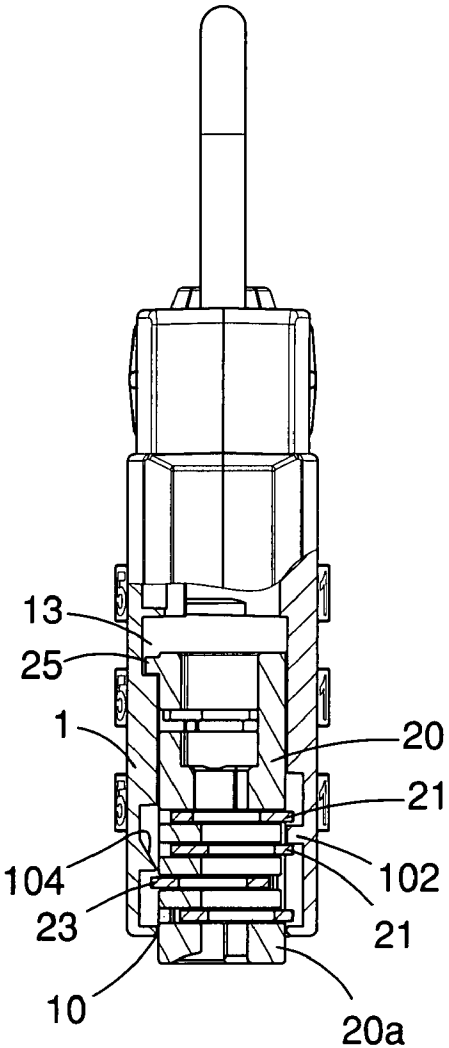
FIG. 9 is similar to FIG. 8, showing that the indicative lock core is partly exposed outside the housing.
Figure 8:
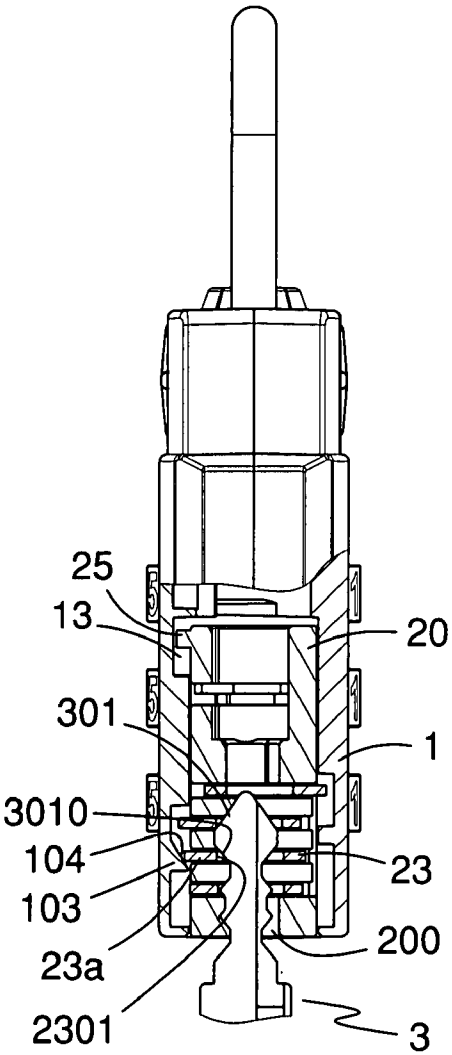
FIG. 8 is similar to FIG. 7, showing that the key is on the way out of the padlock.

As shown in FIG. 8, while the key 3 is drawn out of the keyhole 200 of the spindle 20, a distal end 23*a* of the blocking plate 23 is first slightly-stuck in between an incline 3010 of the highest awl-shaped protrusion 301 and the incline 104 of the rib 103 so that the key 3 can grab and drag the spindle 20 to move together. When the distal end 23*a* of the blocking plate 23 moves with the spindle 20 downward and crosses over the incline 104 of the rib 103, the key 3 then pushes the blocking plate 23 aside via its incline 3010 so that the spindle 20, without the help of the blocking plate 23, is no more movable with the key 3 and remains in an indicative position, as shown in FIG. 9. Then, since the key 3 is no more kept by blocking plate 23, the key 3 may continue to completely move out of the keyhole 200 by itself.

As shown in FIG. 9, when the spindle 20 remains in the indicative position, a lower portion 20*a* of the spindle 20 is situated outside the housing 1. Because the ridge 102 of the housing 1 exactly gets stuck in between two of the latch plates 21, the spindle 20 is stuck and unable to be pushed back to its original position or drawn out further. The portion 20*a* of the spindle 20 situated outside the housing 1 indicates that the spindle 20 has been operated by the key 3. To attract one's attention, the portion 20*a* of the spindle 20 may be painted with a color different from the color of the housing 1. Preferably, there is a contrast between the color of the whole spindle 20 and the color of the housing 1.

As shown in FIGS. 1 and 4, the housing 1 further defines a U-turned shaped channel 13. When the spindle 20 moves or rotates, the protrusion 25 of the spindle 20 moves along the channel 13.

As shown in FIGS. 1 and 2, the lock further includes a restoring device 4 configured to push the portion 20*a* of the spindle 20 back into the housing 1. To install the restoring device 4, the spindle 20 of the indicative lock core 2 further defines a restoring passage 204, each latch plate 21 defines a restoring hole 211, and the blocking plate 23 defines a restoring hole 231. The restoring passage 204 is parallel with the keyhole 200 and in communication with each other. When each latch plate 21 is assembled in the respective latch slot 201, the restoring holes 211 are exactly in alignment/communication with the restoring passage 204. When the blocking plate 23 is assembled in the blocking slot 203, the restoring hole 231 is exactly in alignment/communication with the restoring passage 204. The restoring device 4 includes a restoring plate 40, a spring 41 and a fixing plate 42. The restoring plate 40 has a cone recess 401 and an opposite cone protrusion 402 at the middle.

Figure 10:
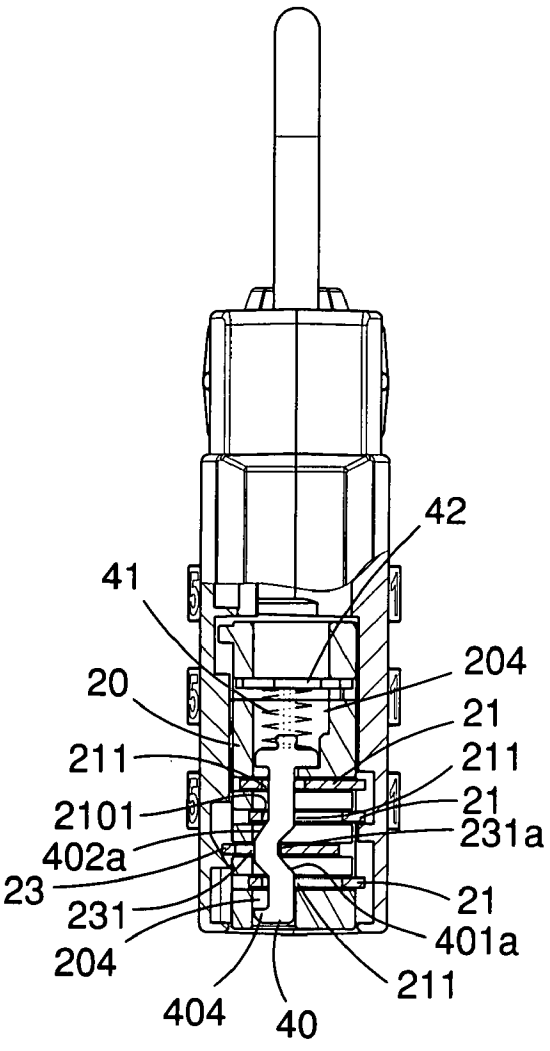
FIG. 10 is another side view, partially broken away to show details of construction, of the padlock of FIG. 2, showing that a restoring plate is included in the padlock.

As shown in FIG. 10, the restoring plate 40 is assembled in the restoring passage 204 and passes through the restoring holes 211 of the latch plates 21 and the restoring hole 231 of the blocking plate 23. The fixing plate 42 is lodged in the spindle 20 and across the restoring passage 204. The spring 41 is biased between the restoring plate 40 and the fixing plate 42. In particular, the restoring hole 231 of the blocking plate 23 is exactly aligned with the middle section of the restoring plate 40. An edge 231*a* of the restoring hole 231 of the blocking plate 23 abuts against a sidewall 401*a* of the cone recess 401. One of the latch plates 21 has its plateau 2101 abutting against a sidewall 402*a* of the cone protrusion 402.

Figure 11:
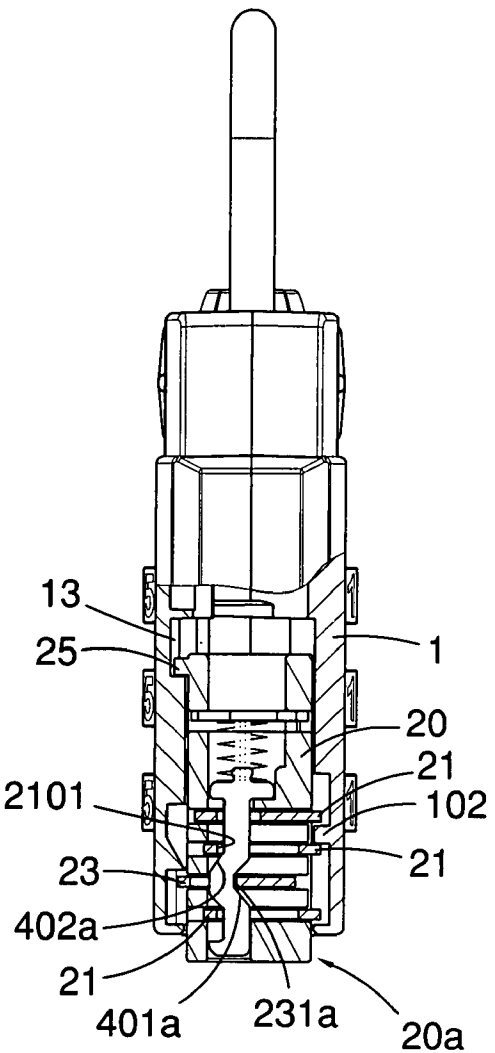
FIG. 11 is similar to FIG. 10, showing that the indicative lock core together with the restoring plate is partly exposed outside the housing.

FIG. 11 illustrates that the spindle 20 is dragged out by the key 3 in order to expose the portion 20*a* and is stuck in the indicative position. At this time, as mentioned above, the ridge 102 of the housing 1 is stuck in between the two latch plates 21. However, a relationship among the restoring plate 40, the latch plates 21 and the blocking plate 23 remains the same.

Figure 12:
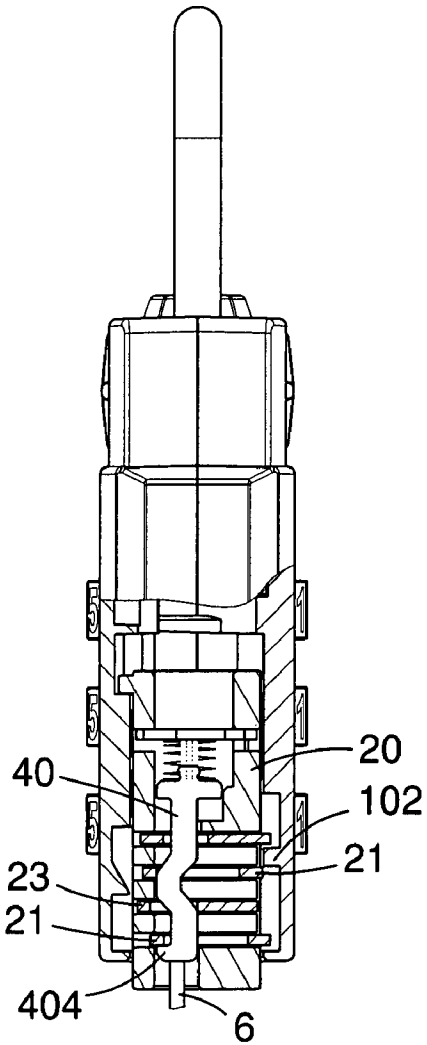
FIG. 12 is similar to FIG. 11, showing that the restoring plate is pushed back into the housing by an insert.

FIG. 12 illustrates that a tool 6, such as an elongated stem or a thin strip, is used to push the restoring plate 40 inward a bit. At this time, one of the latch plates 21, which is originally blocked by the ridge 102, and the blocking plate 23 are both pressed by the restoring plate 40 to retract, and a hook portion 404 of the restoring plate 40 contacts with a bottom of the lowest latch plate 21, and thereby the spindle 20 is in a state ready to be moved inward. The tool 6 can be pushed inward further so as to bring the spindle 20 completely into the housing 1, as shown in FIG. 10.

According to the above, the spindle 20 can be rotated by rotation of the key 30 so as to lock or unlock the lock. In particular, the spindle 20 can be dragged out and partly situated outside the housing 1 by drawing out the key 3 from the spindle 20 to indicate that the indicative lock core 2 has been operated or activated by the key 3.

As shown in FIG. 1, the lock is a padlock. That is, the lock includes a shackle 6. The shackle 6 has a root section 60 and a free section 61. The root section 60 is disposed in the housing 1. The free section 61 extends from the root section 60 and disposed outside the housing 1.

In order to become a dual lock, the lock further includes a combination lock core 7 and a controlling unit 8. The combination lock core 7 includes a movable part 70 and a plurality of numeral wheels 71. When a correct combination on the numeral wheels 71 is dialed, the movable part 70 is allowed to move axially. When a wrong combination on the numeral wheels is dialed, the movable part 70 is locked and is not allowed to move axially. In this embodiment, the movable part 70 is composed of an upright stem 702 and a lateral stem 701 joined to the upright stem 702 in order that a distal end 70*a* of the movable part 70 can reach to the controlling unit 8.

The controlling unit 8 is disposed in the housing 1 and is able to rotate and move axially. The root section 60 of the shackle 6 is rotatably mounted on the controlling unit 8 via a U-shaped latch K so that the shackle 6 can rotate to enable its free section 61 to be close to or away from the housing 1. The controlling unit 8 is formed with a block 80 and a driving member 81. The driving member 81 is wedged in a notch 205 of the spindle 20 so that the driving member 81 together with other parts of the controlling unit 8 can rotate with the spindle 20, and thereby the spindle 20 can be used to drive the controlling unit 8. Moreover, the driving member 81 is capable of axially moving with respect to the notch 205. An elastic plate M, as shown in the figure, is mounted around the controlling unit 8 for elastically securing the controlling unit 8 when controlling unit 8 rotates.

Figure 13:
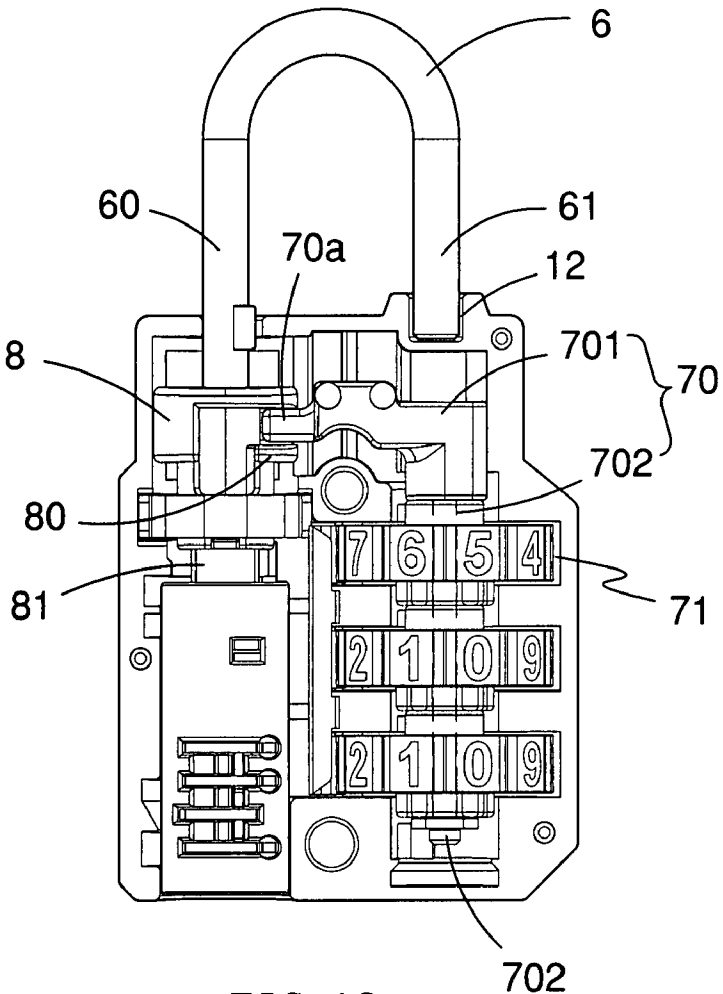
FIG. 13 is a schematic view of an inside of the padlock of FIG. 2, showing that the padlock is in a locking state.

FIG. 13 illustrates that the padlock is in a locking state. At this time, an end of the free section 61 of the shackle 6 is received in a locking hole 12 of the housing 1. The correct combination on the numeral wheels 71 is not entered yet so that the movable part 70 is not allowed to move axially. In this state, the block 80 of the controlling unit 8 together with the shackle 6 is not allowed to move axially due to obstruction of the distal end 70*a* of the movable part 70.

Figure 14:
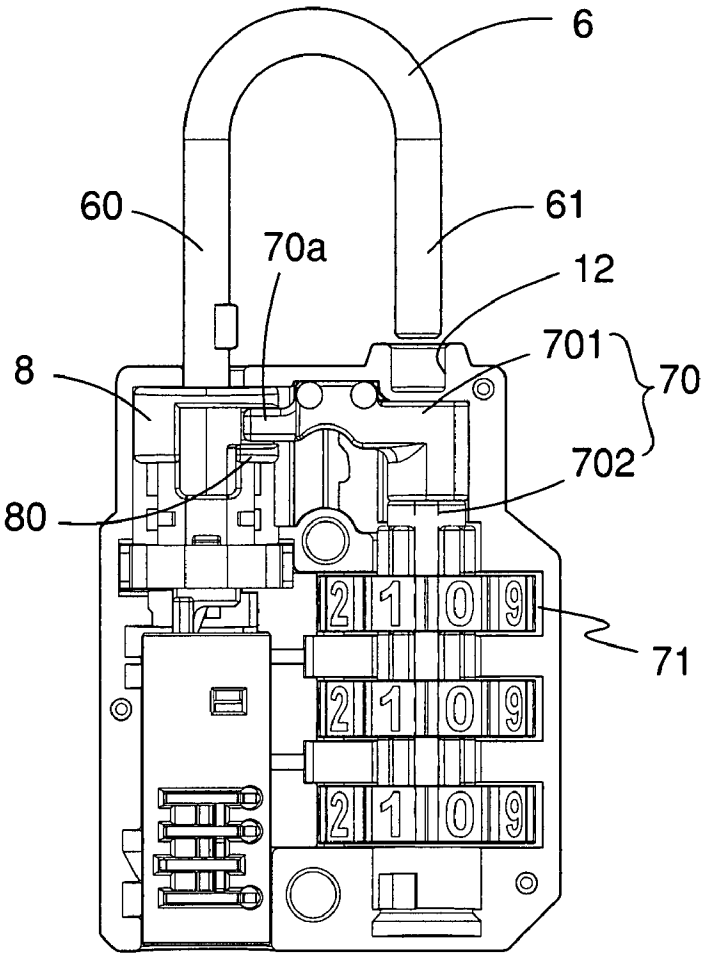
FIG. 14 is similar to FIG. 13, showing that a correct combination of the combination lock core of the padlock is entered and the shackle is lifted up to have the padlock enter into an unlocking state.

As shown in FIG. 14, when the correct combination on the numeral wheels 71 is set and the movable part 70 is allowed to move axially, the free section 61 of the shackle 6 can be pulled away from the locking hole 12 of the housing 1. Specifically, since the distal end 70*a* of the movable part 70 becomes movable, the controlling unit 8 and the movable part 70 are allowed to move axially with the shackle 6, and thereby the free section 61 of the shackle 6 can be released from the locking hole 12 of the housing 1 so as to have the padlock in an unlocking state.

Figure 16:
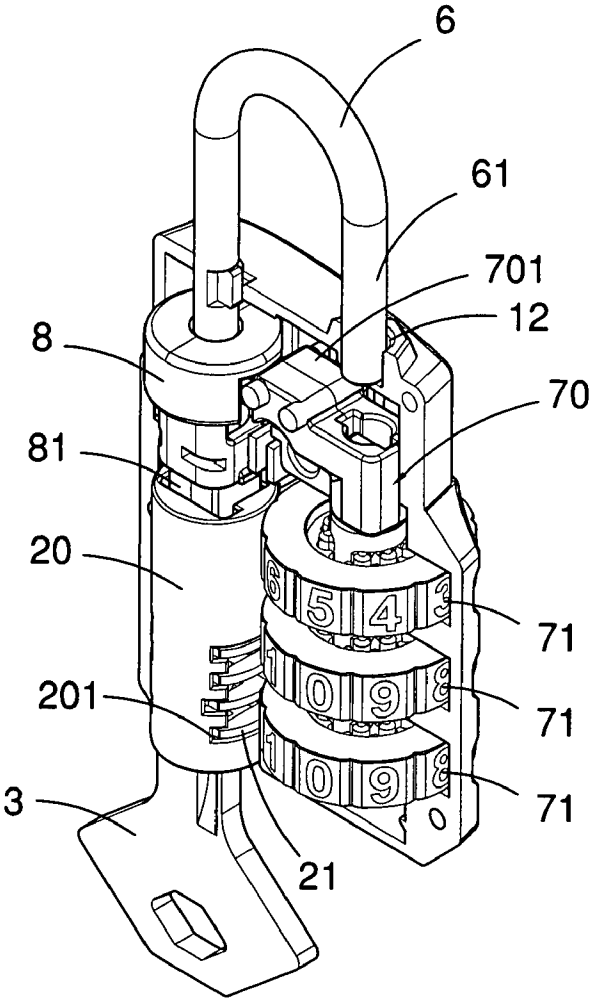
FIG. 16 is similar to FIG. 15, showing that the indicative lock core is driven to rotate by the key.
Figure 15:
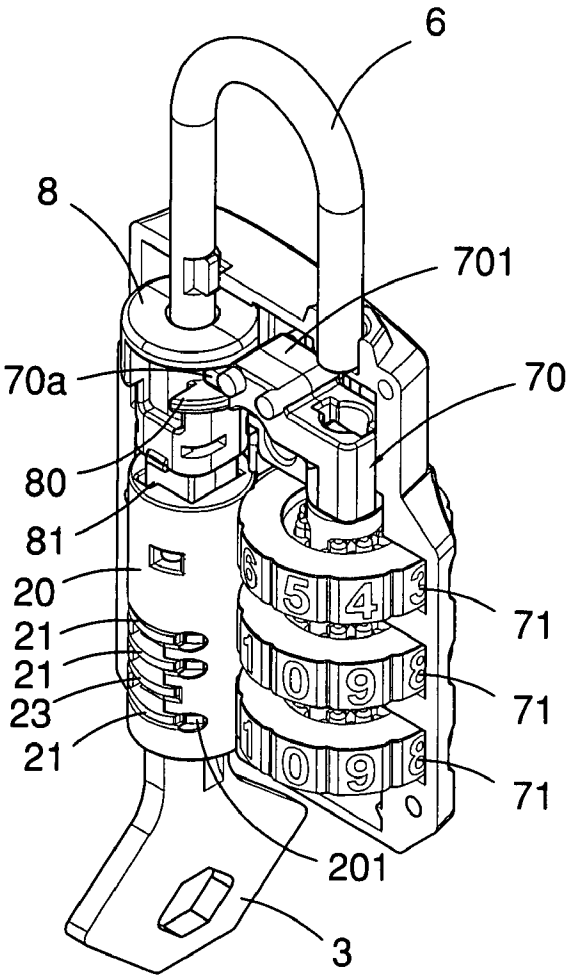
FIG. 15 is a partly perspective view of the padlock of FIG. 2, showing that the key is inserted into the indicative lock core of the padlock.
Figure 17:
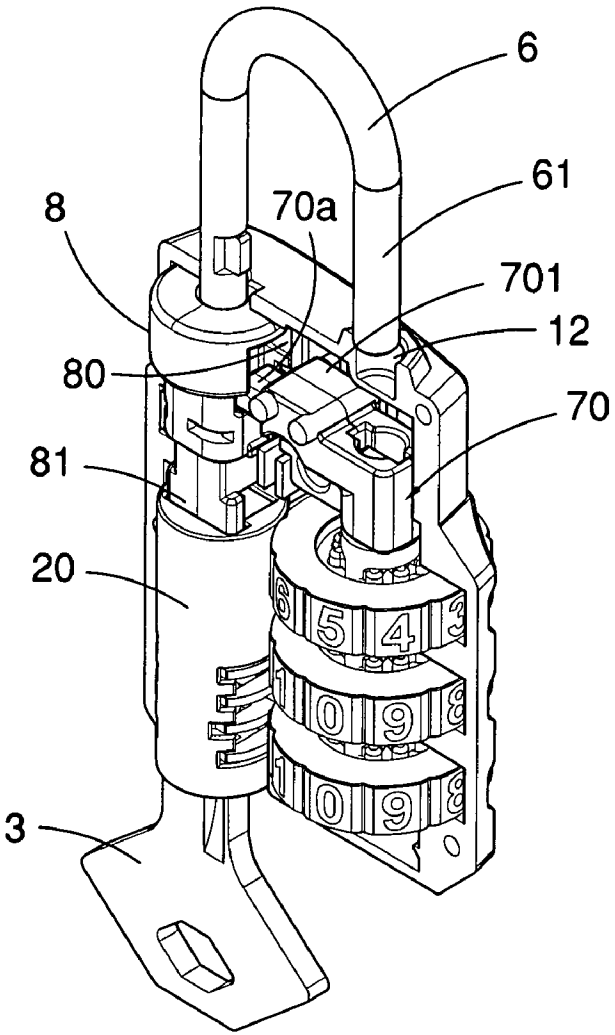
FIG. 17 is similar to FIG. 16, showing that the shackle of the padlock is lifted up.

FIGS. 15 and 16 show that the correct combination on the numeral wheels 71 is not entered so that the movable part 70 is not allowed to move axially. In FIG. 15, the aforementioned key 3 has been inserted into the keyhole 200 of the spindle 20 to have the latch plates 21 retract into latch slots 201 and away from the room 100 of the housing 1 respectively. In the meantime, the spindle 20 is allowed to be rotated by the key 3 so as to drive the controlling unit 8 to rotate, as illustrated above. FIG. 16 illustrates that the controlling unit 8 has been rotated to a specific position where the block 80 is departed from the distal end 70*a* of the movable part 70 and is movable with respect to the movable part 70 so that the free section 61 of the shackle 6 is allowed to be pulled away from the housing 1. Specifically, since the end 70*a* of the movable part 70 obstructs the block 80 or other parts of the controlling unit 8 no more, the controlling unit 8 is allowed to move axially with the shackle 6 simultaneously to enable the free section 61 of the shackle 6 to be removed away from the locking hole 12 of the housing 1 so as to have the padlock enter into an unlocking state, as shown in FIG. 17.

As stated above, even if the correct combination on the numeral wheels 71 is not entered, the controlling unit 8 is movable axially by operation of the indicative lock core 2 in order to have the free section 61 of the shackle 6 released from the housing 1.

Figure 18:
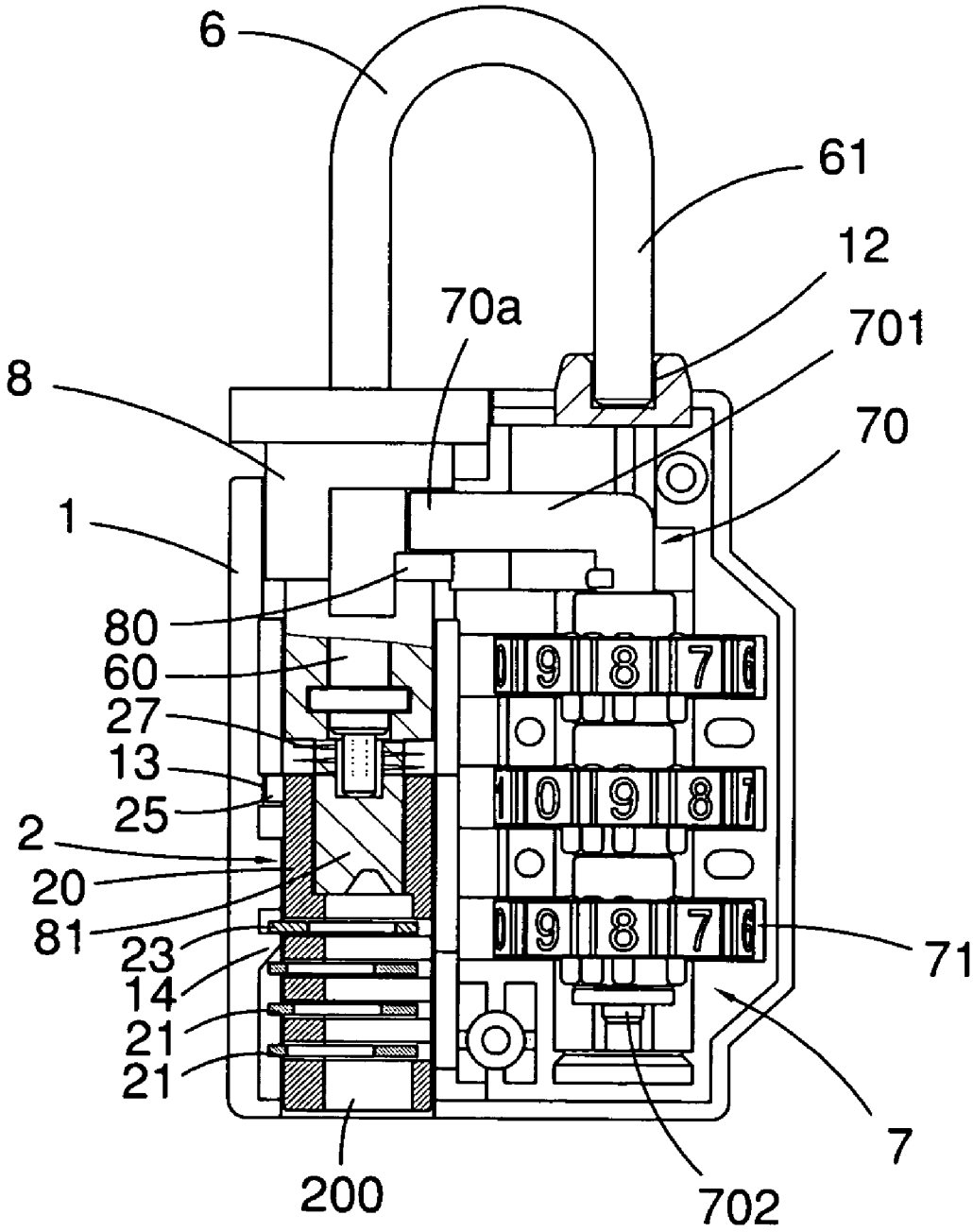
FIG. 18 is a schematic view of a padlock according to a second embodiment of the present invention.
Figure 19:
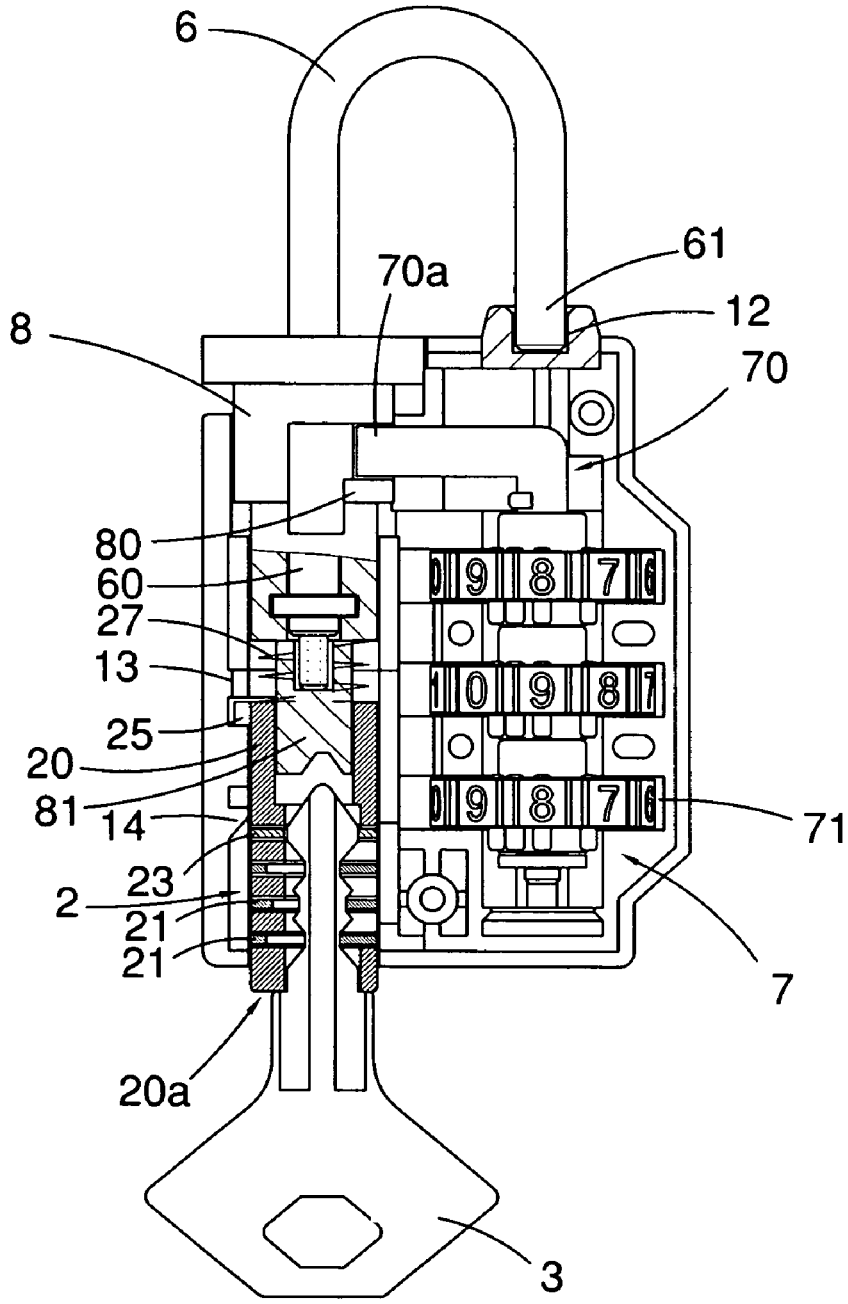
FIG. 19 is similar to FIG. 18, showing that an indicative lock core of the padlock is partly bounced out of the housing once a key is inserted into a keyhole of the indicative lock core.
Figure 20:
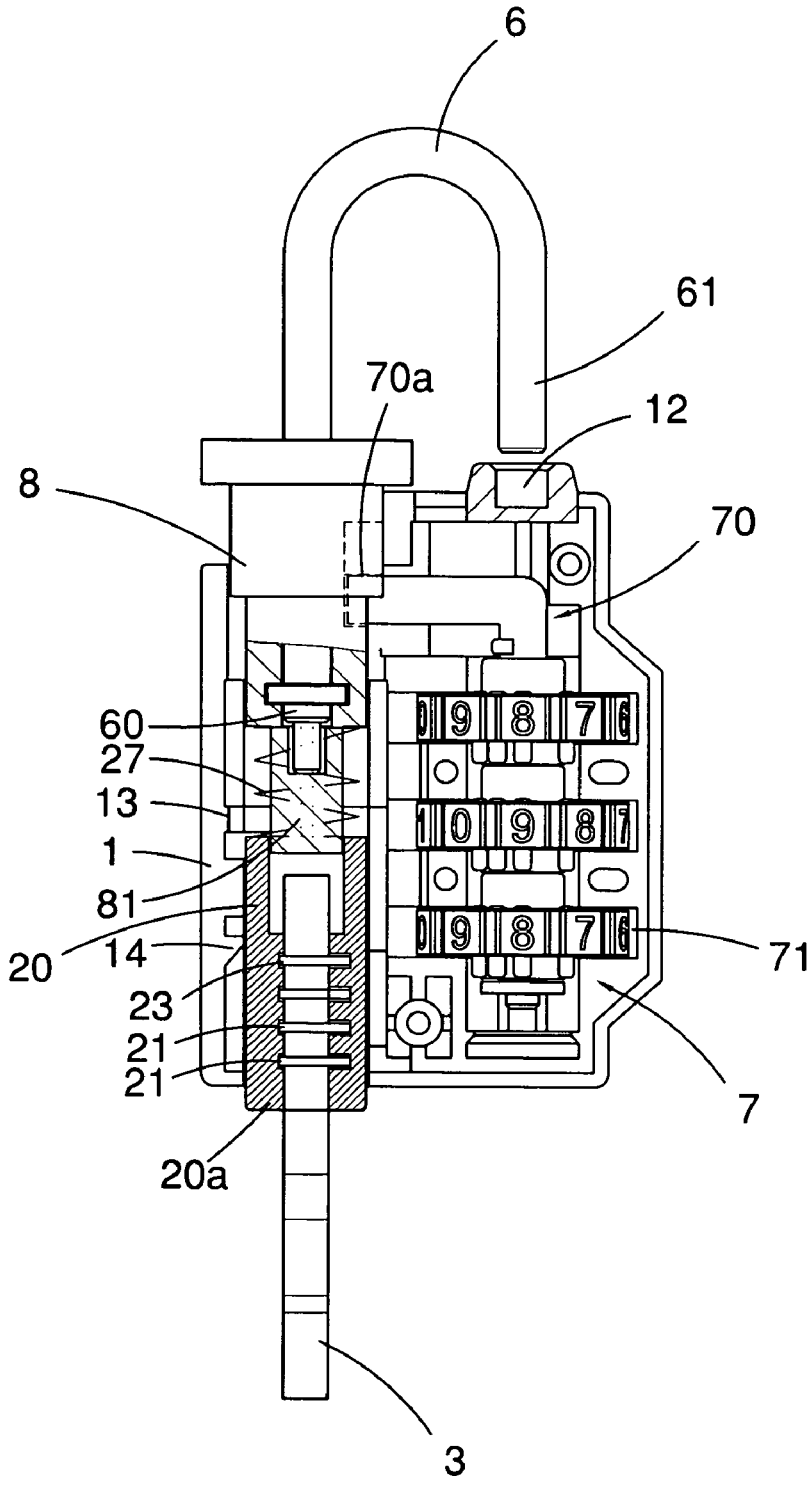
FIG. 20 is similar to FIG. 19, showing that the shackle of the padlock is lifted up once the key drives the indicative lock core to rotate.

FIGS. 18, 19 and 20 illustrate a padlock in accordance with a second embodiment of the present invention. The second embodiment is generally similar to the first embodiment with same references designated for the same features. FIG. 18 illustrates that the padlock is in a locking state. At this time, the end of the free section 61 of the shackle 6 is lodged in the locking hole 12 of the housing 1. The correct combination on the numeral wheels 71 is not entered, so the movable part 70 is not allowed to move axially. In this state, the block 80 of the controlling unit 8 together with the shackle 6 is not allowed to move axially due to obstruction of the distal end 70*a* of the movable part 70.

As shown in FIG. 19, when the key 3 is inserted into the keyhole 200 of the spindle 20 of the indicative lock core 2 of the padlock, the blocking plate 23 moves away from a flange 14 of the housing 1 and draws back into the blocking slot 203 so as to have the spindle 20 partly be bounced out of the opening 10 of the housing 1 by a spring 27 to an indicative position where the lower portion 20*a* of the spindle 20 exposed outside the housing 1.

Referring to FIG. 20, the driving member 81 of the controlling unit 8 is engaged with the spindle 20 so that when the spindle 20 is rotated by the key 3, the spindle 20 drives the controlling unit 8 to rotate in order to have the block 80 depart from the distal end 70*a* of the movable part 70 of the combination lock core 7. At the same time, the shackle 6 partly bounces off the housing 1 as a result of the remaining resilience of the spring 27 and the padlock enters into the unlocking state as depicted in FIG. 20.

Figure 21:
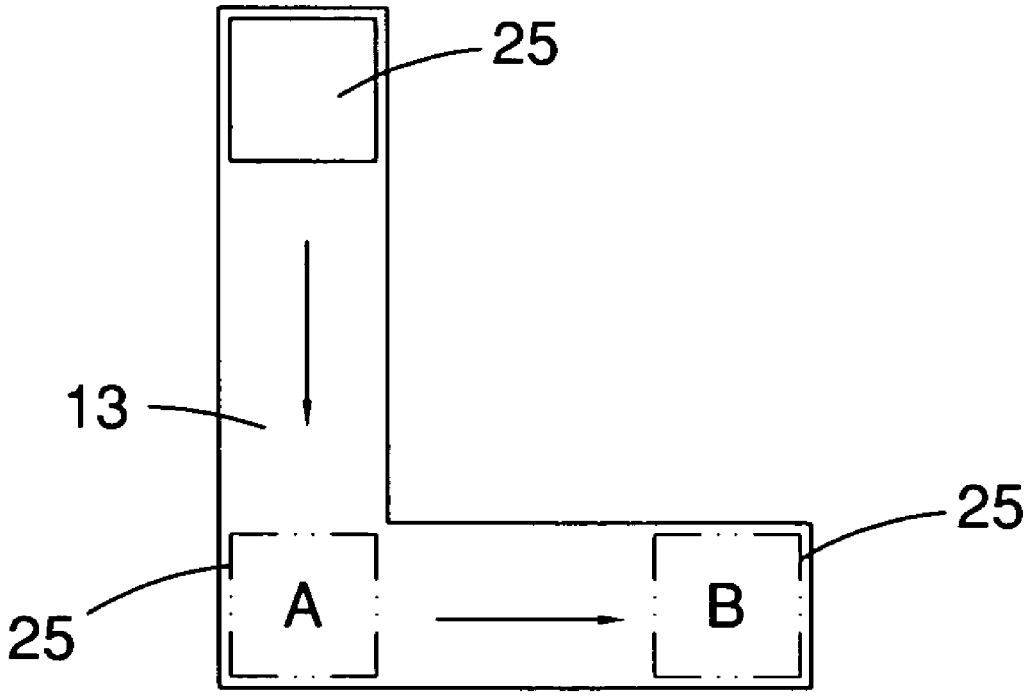
FIG. 21 is a schematic view showing a route of a protrusion formed on a spindle of the indicative lock core of FIG. 18.

Referring to FIGS. 20 and 21, when the spindle 20 bounces out of the housing 1 by the bounce of the spring 27, the protrusion 25 formed on the spindle 20 moves with the spindle 20 along the channel 13 of the housing 1 to a position A. When the spindle 20 is rotated by the key 3, the protrusion 25 rotates with the spindle 20 along the channel 13 to a position B.

If restoration of the spindle 20 is needed, a user may simply push the spindle 20 directly by hand to have the spindle 20 completely back into the housing 1, as shown in FIG. 18.

As described above, it is understood that the spindle 20 of the second embodiment moves immediately to the indicative position once the key 3 is inserted into the spindle 20 due to the bounce of the spring 27, which makes the second embodiment greatly different from the first embodiment.

FIGS. 22 to 27 illustrate a padlock in accordance with a third embodiment of the present invention. The third embodiment is generally similar to the foregoing embodiments with same references designated for the same features. In the third embodiment, the housing 1 further defines a blocking channel 12*a* and a limit channel 13*a* therein. When the spindle 20 rotates or moves axially, the blocking plate 23 moves along the blocking channel 12*a* and the protrusion 25 which is on the spindle 20 moves along the limit channel 13*a*.

Figure 24:
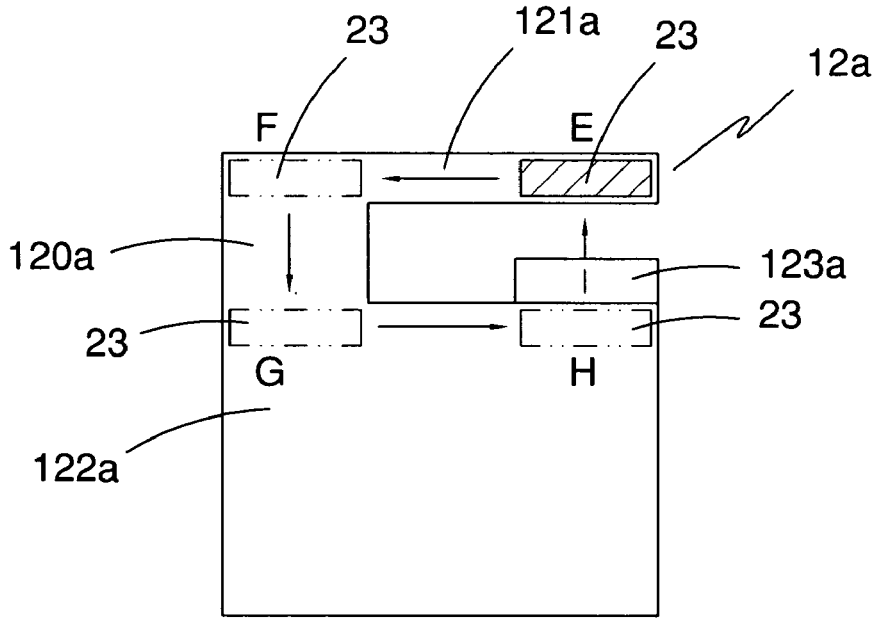
FIG. 24 is a schematic view showing a route of a blocking plate disposed on the indicative lock core of FIG. 22.

As shown in FIG. 24, the blocking channel 12*a* has a vertical section 120*a*, a first horizontal section 121*a* and a second horizontal section 122*a*. The first horizontal section 121*a* extends from an upper portion of the vertical section 120*a*. The second horizontal section 122*a* extends from a lower portion of the vertical section 120*a* and lies under the first horizontal section 121*a*. A guiding slope 123*a*, as shown in FIG. 22, is defined at a top edge wall of the second horizontal section 122*a*.

Figure 22:
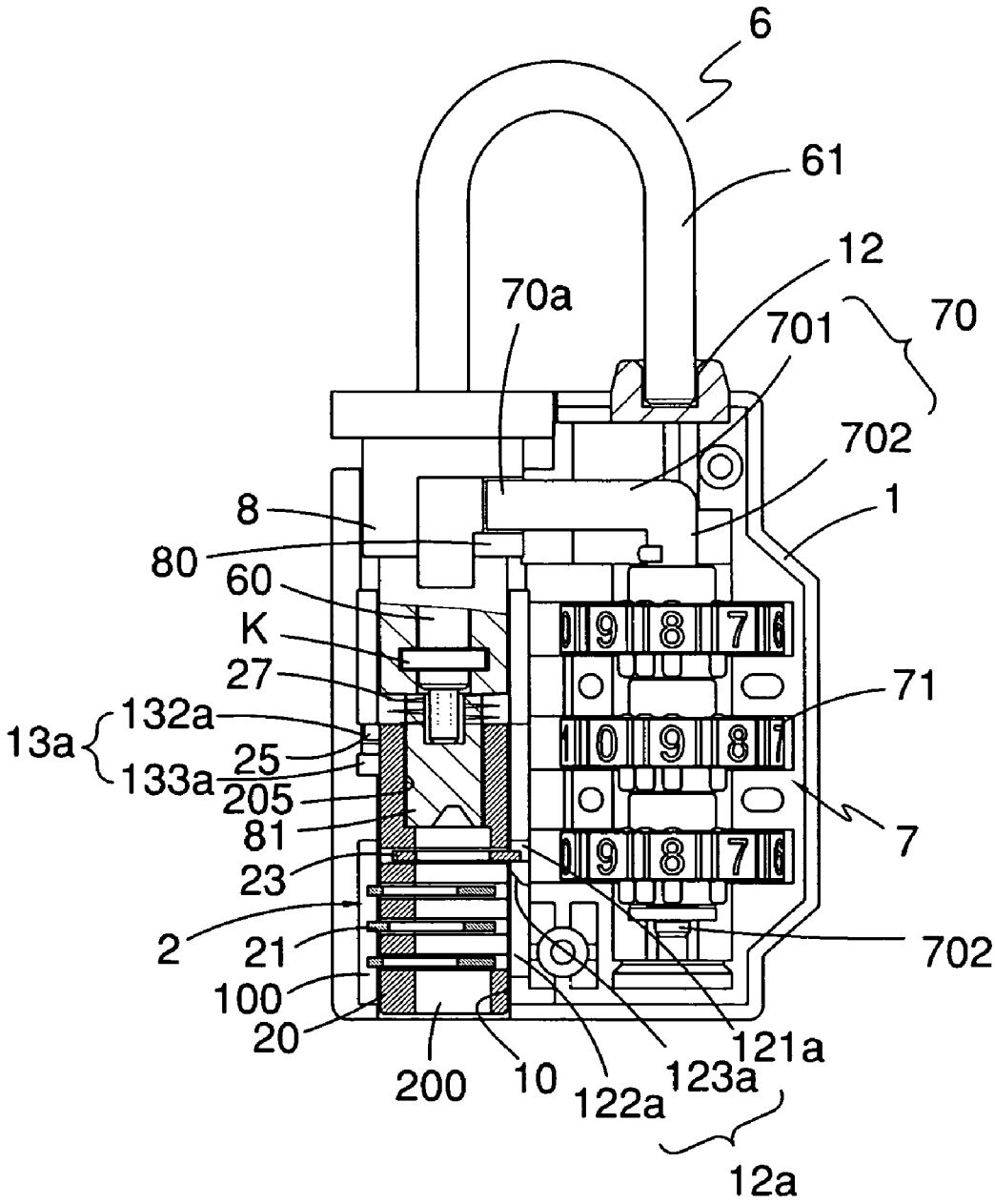
FIG. 22 is a schematic view of a padlock according to a third embodiment of the present invention.
Figure 23:
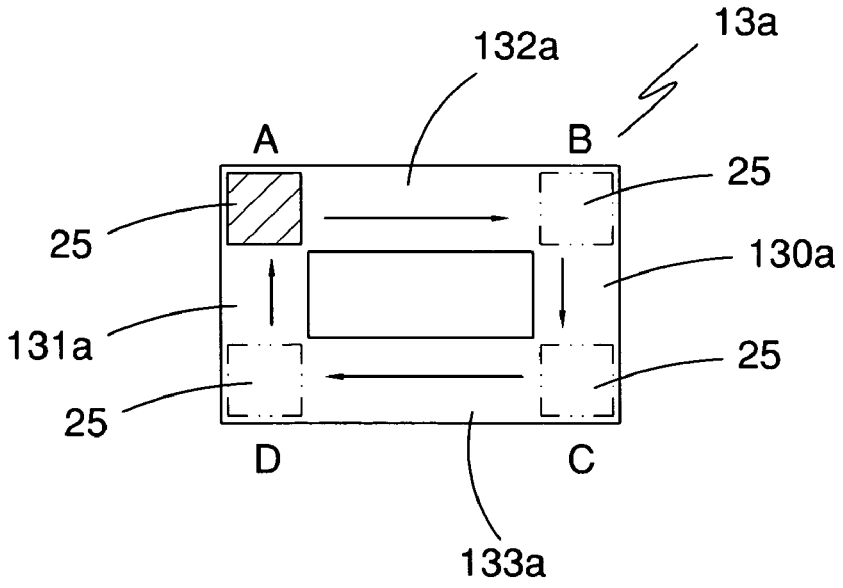
FIG. 23 is a schematic view showing a route of a protrusion formed on a spindle of the indicative lock core of FIG. 22.

As shown in FIGS. 22 and 23, the limit channel 13*a* functions as the channel 13 of the first embodiment, but differs in configuration. Specifically, the limit channel 13*a* has a first vertical section 130*a*, a second vertical section 131*a*, a first horizontal section 132*a* and a second horizontal section 133*a*. The first horizontal section 132*a* connects an upper portion of the first vertical section 130*a* and an upper portion of the second vertical section 131*a*. The second horizontal section 133*a* connects a lower portion of the first vertical section 130*a* and a lower portion of the second vertical section 131*a*.

Figure 25:
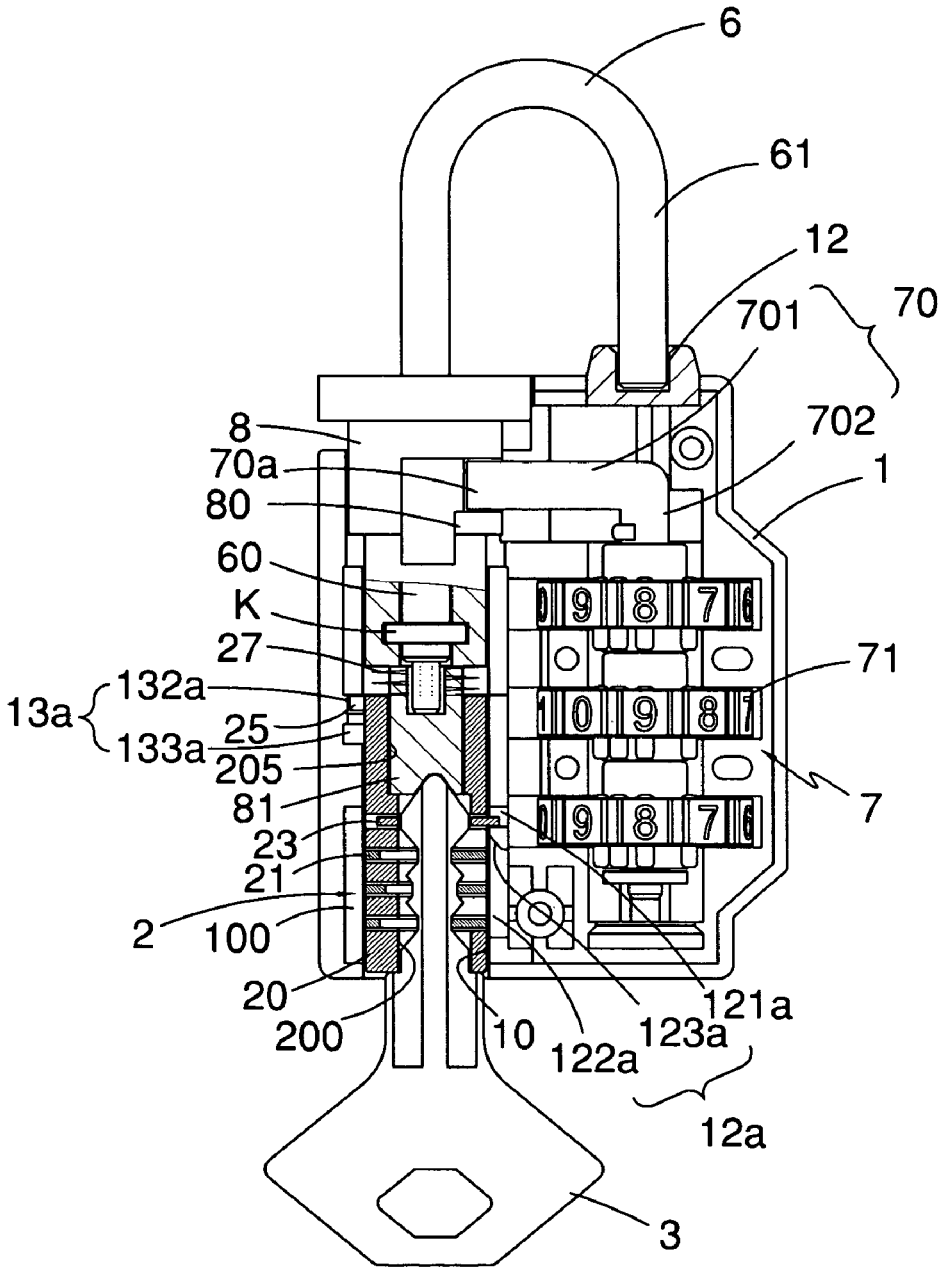
FIG. 25 is similar to FIG. 22, showing that a key is inserted into the padlock.

FIGS. 22 and 25 both illustrate that the padlock is in a locking state. At this time, further referring to FIGS. 23 and 24, the protrusion 25 is located in the intersection of the first horizontal section 132*a* and the second vertical section 131*a* of the limit channel 13*a*, and the blocking plate 23 is lodged in the first horizontal section 121*a* of the blocking channel 12*a* so that the spindle 20 is not allowed to move axially. When the key 3 is inserted into the keyhole 200 of the spindle 20, as shown in FIG. 25, the key 3 drives the latch plates 21 to draw back from the room 100 of the housing 1, except the blocking plate 23, so that the spindle 20 is allowed to be rotated subsequently, but not allowed to be moved axially.

Figure 26:
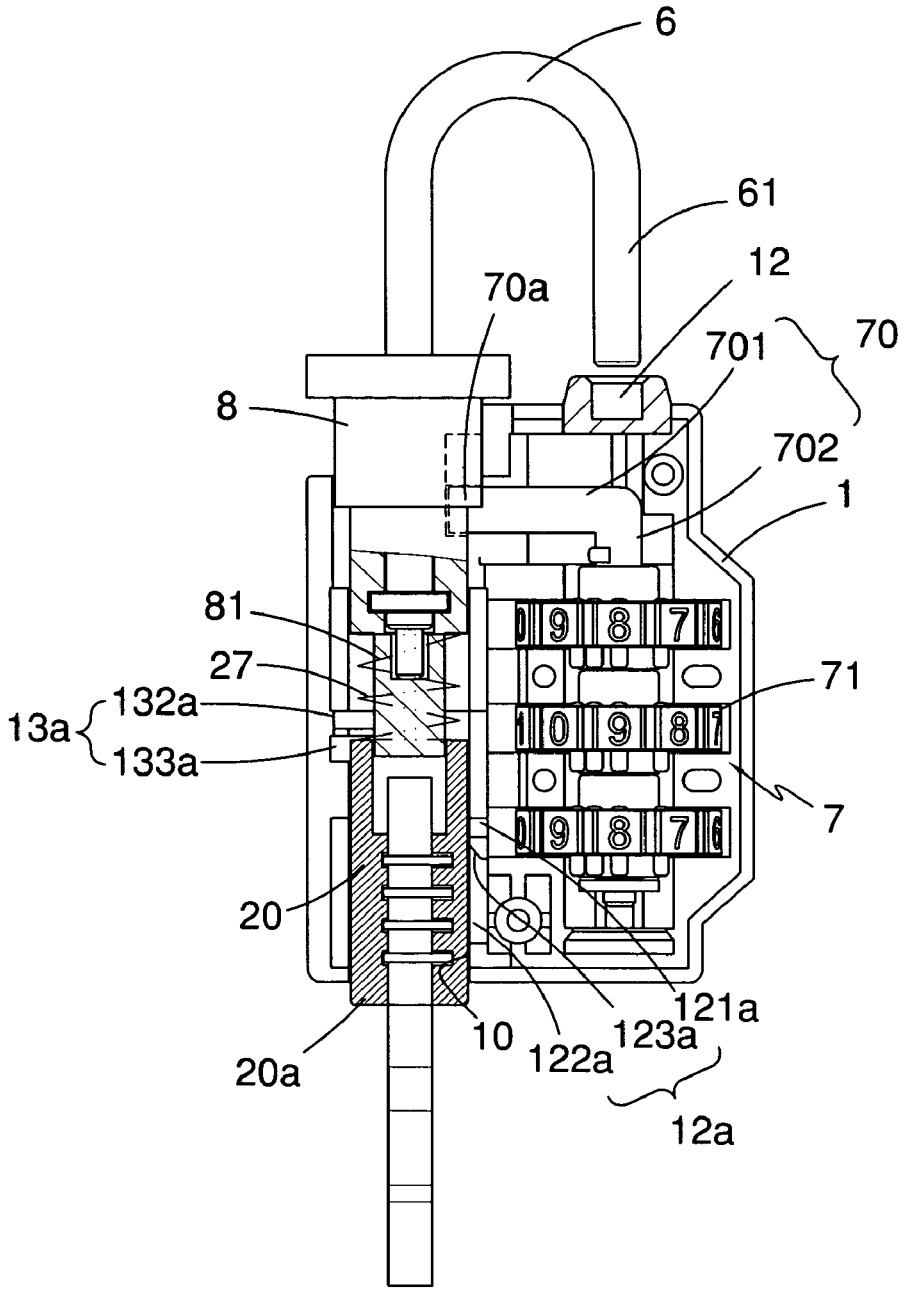
FIG. 26 is similar to FIG. 25, showing that the indicative lock core is partly bounced out of the housing when the key drives the indicative lock core to rotate.

FIG. 26 shows that the spindle 20 is rotated by the key 3 and moves axially to the indicative position as a result of the bounce of the spring 27. In the meanwhile, referring back to FIG. 23, the protrusion 25 rotates with the spindle 20 along the first horizontal section 132*a* and then moves downward with the spindle 20 along the first vertical section 130*a*. Specifically, the protrusion 25 goes from the intersection A of the first horizontal section 132*a* and the second vertical section 131*a* to the intersection B of the first horizontal section 132*a* and the first vertical section 130*a*, and finally to the intersection C of the first vertical section 130*a* and the second horizontal section 133*a*. At the same time, as shown in FIG. 24, the blocking plate 23 rotates with the spindle 20 along the first horizontal section 121*a* and then moves downward with the spindle 20 along the vertical section 120*a*. Specifically, the blocking plate 23 goes from the position E to the intersection F of the first horizontal section 121*a* and the vertical section 120*a*, and finally to the intersection G of the vertical section 120*a* and the second horizontal section 122*a*.

As shown in FIG. 26, the driving member 81 of the controlling unit 8 is engaged with the spindle 20. Accordingly, when the spindle 20 is rotated by the key 3, the spindle 20 drives the controlling unit 8 to rotate in order to have the block 80 depart from the distal end 70*a* of the movable part 70 of the combination lock core 7. Immediately, the shackle 6 partly bounces off the housing 1 as a result of the remaining resilience of the spring 27 and the padlock enters into the unlocking state.

Figure 27:
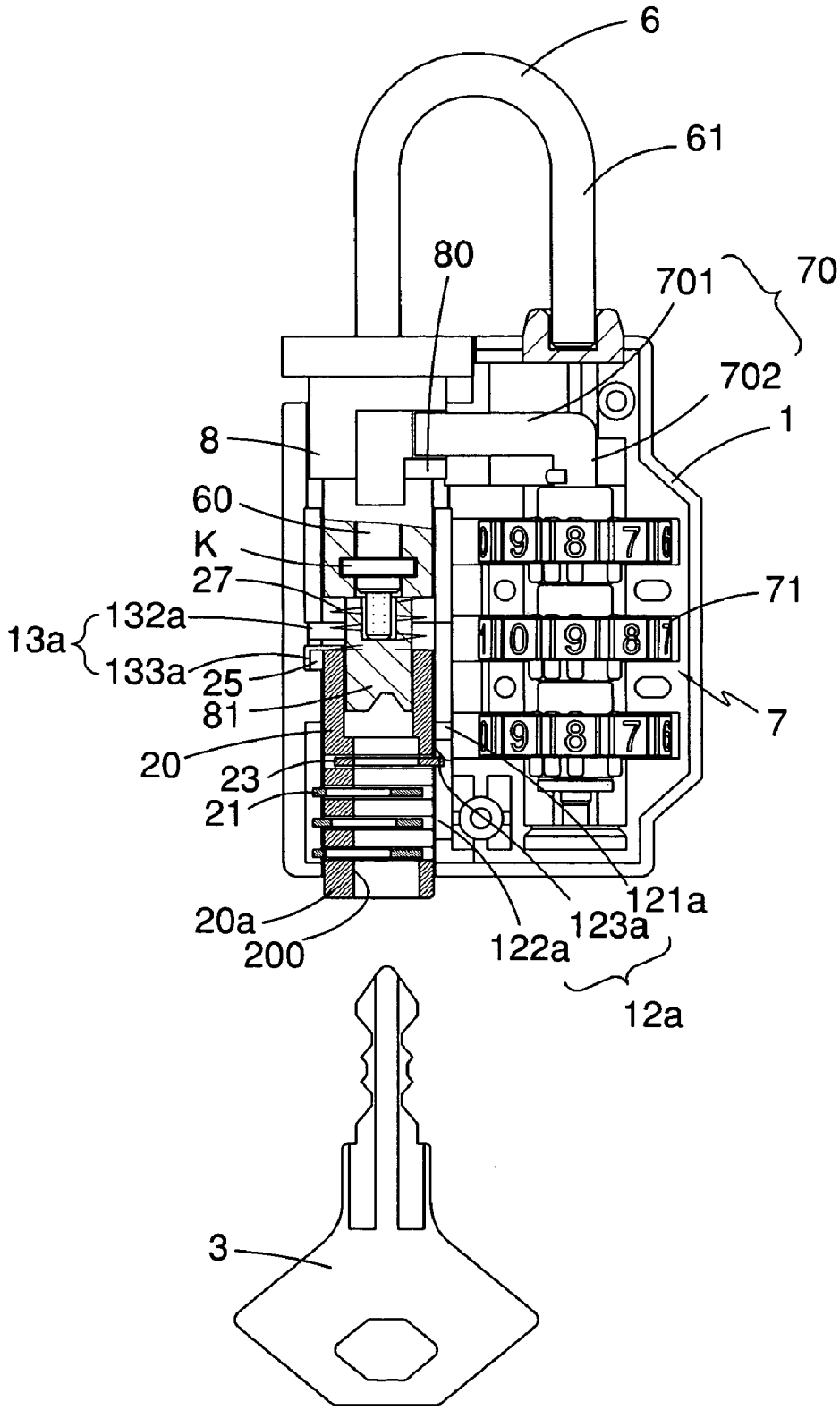
FIG. 27 is similar to FIG. 26, showing that the indicative lock core remains in the indicative position even if the key is rotated reversely and extracted from the indicative lock core.

In FIG. 27, the spindle 20 is reversely rotated by the key 3, the key 3 is taken out of the indicative lock core 2, and the shackle 6 is pushed back into its locking position. The padlock enters into the locking state. While the spindle 20 is reversely rotated, the protrusion 25 goes from the intersection C to the intersection D of the second vertical section 131*a* and the second horizontal section 133*a*, as shown in FIG. 23; and the blocking plate 23 goes from the intersection G to the position H, as shown in FIG. 24. Compared FIG. 27 with FIG. 22, the spindle 20 of FIG. 27 remains in the indicative position where the lower portion 20*a* exposed outside the housing 1. If restoration of the spindle 20 is needed, a user may simply push the spindle 20 directly by hand to have the spindle 20 completely back into the housing 1. While the spindle 20 is moving back into the housing 1, the protrusion 25 moves from the intersection D to the intersection A. Additionally, a guiding slope 123*a* of the second horizontal section 122*a* leads the blocking plate 23 from the position H of the second horizontal section 122*a* to the position E of the first horizontal section 121*a* and be lodged therein, as shown in FIGS. 22 and 24.

As described above, it is understood that the spindle 20 of the third embodiment moves to the indicative position by the spring 27 only when the key 3 is inserted into the spindle 20 and drives the spindle 20 to rotate, which makes the third embodiment greatly different from the second embodiment.

FIGS. 28 to 32 illustrate a padlock in accordance with a fourth embodiment of the present invention with the same references designated for the same features. The fourth embodiment is generally similar to the first, second and third embodiments, except that a restoring plate 40*a* is included in the fourth embodiment, but the spring 27 is excluded from the fourth embodiment. The restoring plate 40*a* functions as the restoring plate 40 of the first embodiment. Specifically, the restoring plate 40*a* is joined to the controlling unit 8, more particularly to a bottom of the driving member 81 of the controlling unit 8.

Figure 29:
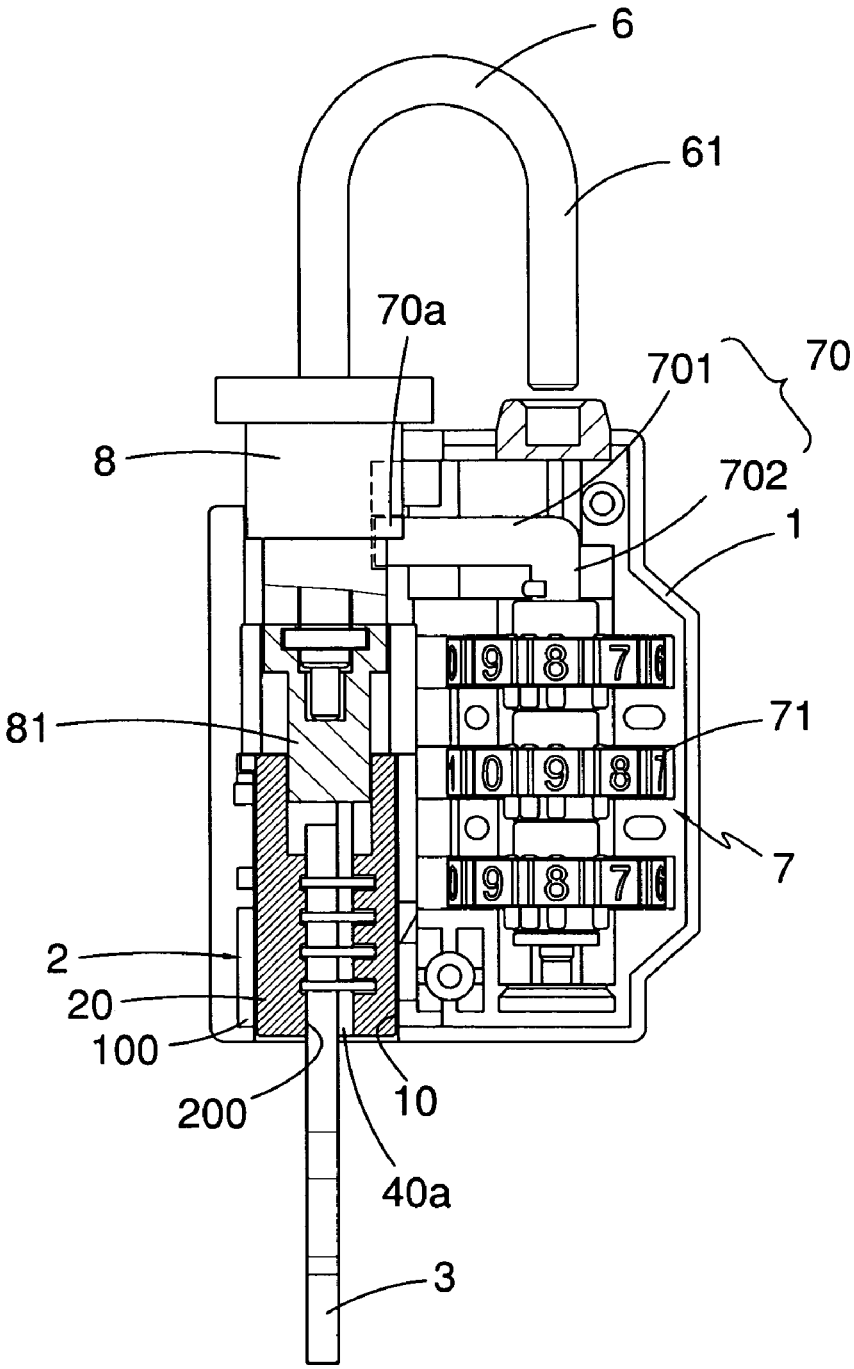
FIG. 29 is similar to FIG. 28, showing that a key is inserted and rotated in the indicative lock core of the padlock to enable the shackle to be lifted up.

In FIG. 29, the key 3 is inserted into the keyhole 200 of the spindle 20 of the indicative lock core 2 and drives the spindle 20 to rotate clockwise by 90 degrees. The block 80 of the controlling unit 8 rotates with the spindle 20 to depart from the distal end 70*a* of the movable part 70 of the combination lock core 7. At this time, the shackle 6 which is engaged with the controlling unit 8 is ready to be moved. Once the shackle 6 is pulled upward, the padlock enters into its unlocking state, as shown in FIG. 29.

Figure 28:
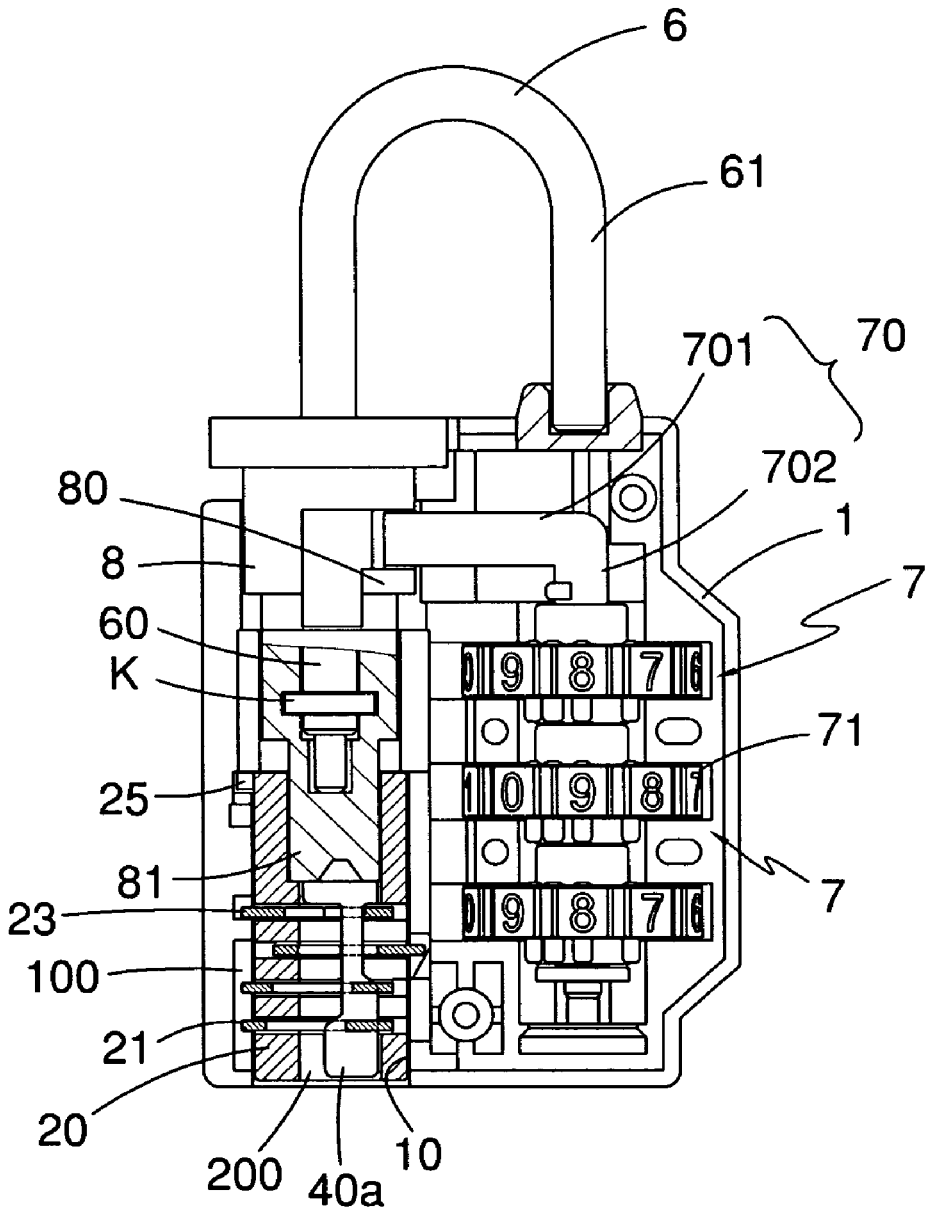
FIG. 28 is a schematic view of a padlock according to a fourth embodiment of the present invention.
Figure 30:
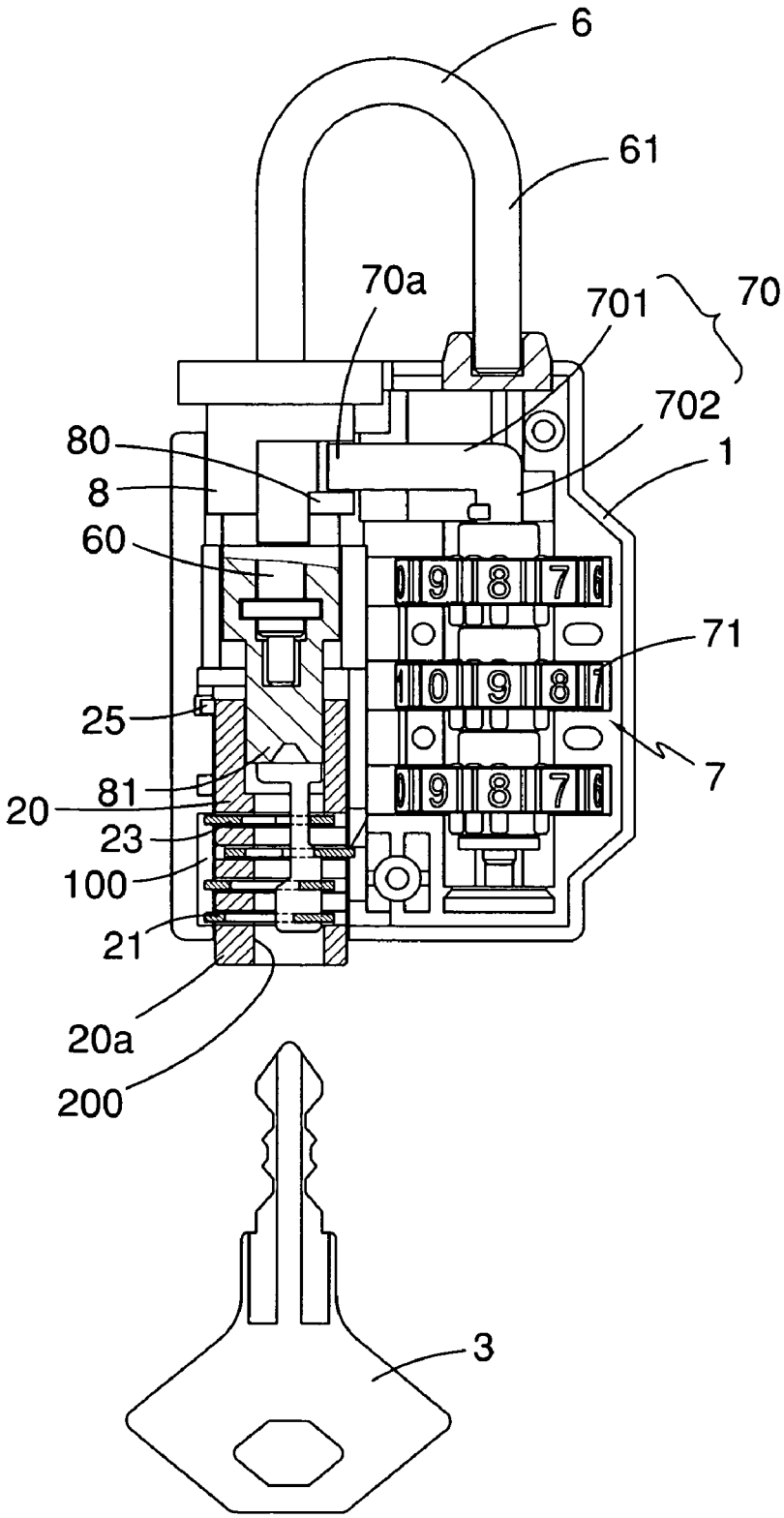
FIG. 30 is similar to FIG. 29, showing that when the key is pulled out of the indicative lock core, the indicative lock core moves with the key to have its lower portion exposed outside the housing.

In FIG. 30, the key 30 is rotated reversely to have the padlock return back to a state, as shown in FIG. 28, and then is taken out of the padlock. Similar to the first embodiment, while the key 3 of this fourth embodiment is pulled out, the spindle 20 moves with the key 3 a bit to have its lower portion 20*a* exposed outside the housing 1.

Figure 31:
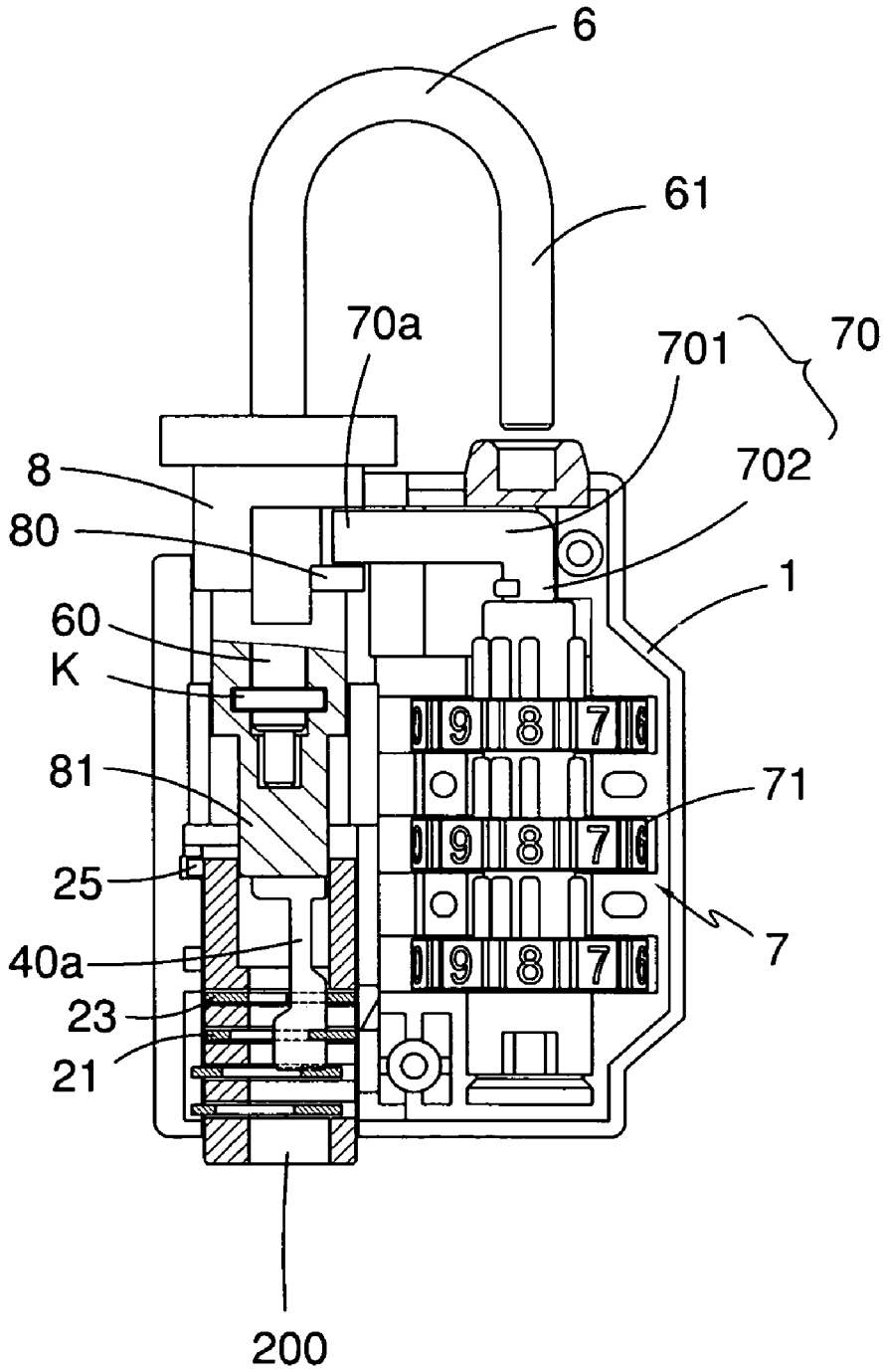
FIG. 31 is similar to FIG. 30, showing that a restoring device of the padlock can move with the shackle upward when a correct combination of the combination lock core is entered.
Figure 32:
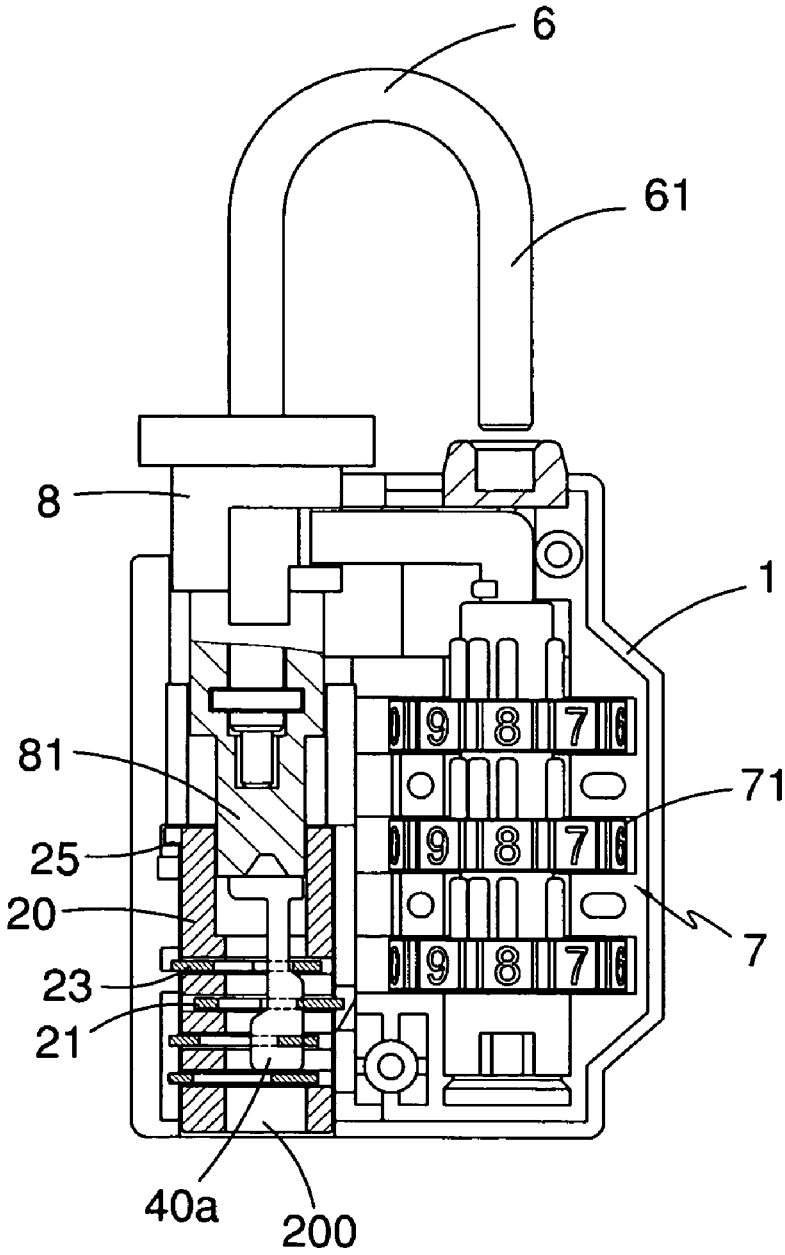
FIG. 32 is similar to FIG. 31, showing that the indicative lock core is allowed to be pushed back into the housing after the upward movement of the restoring device.

FIG. 31 illustrates that the combination lock core 7 is entered the correct combination, and the shackle 6 is lifted up to have the padlock enter its unlocking state. At this time, since the restoring plate 40*a* is joined to the controlling unit 8 which is engaged with the shackle 6, the restoring plate 40*a* moves upward with the shackle 6 and the controlling unit 8. Due to the upward movement of the restoring plate 40*a*, the blocking plate 23 and the latch plates 21 are pushed aside by the restoring plate 40*a* and draw back into the spindle 20, which allows the spindle 20 to be returned to its original position. That is, the spindle 20 can be easily pushed back to its original position by hand, as shown in FIG. 32.

As described above, it is understood that the spindle 20 of the fourth embodiment moves to the indicative position when the key 3 is extracted from the keyhole 200, which is similar to the first embodiment; however, the spindle 20 can be returned back into the housing only when the correct combination of the combination lock core 7 is entered, which makes the fourth embodiment greatly different from the first embodiment.

Figure 33:
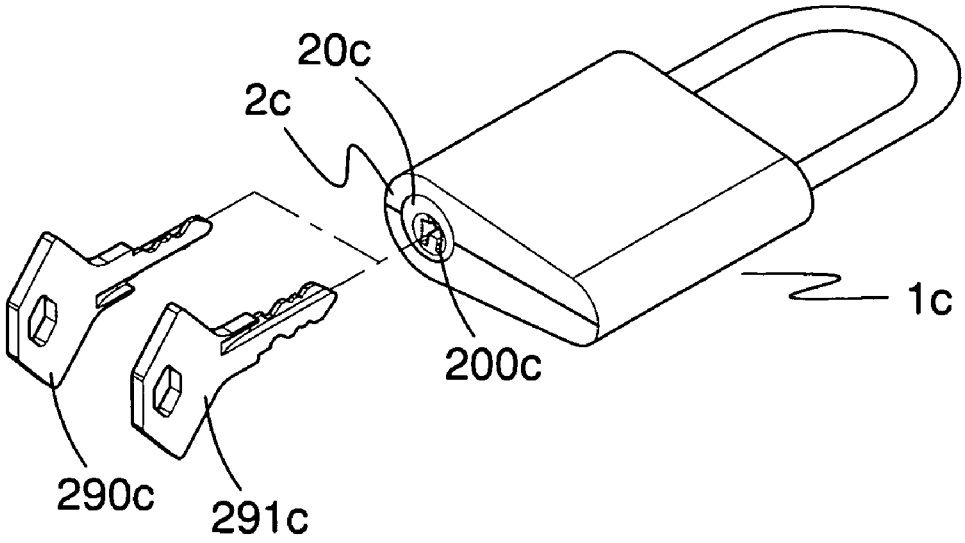
FIG. 33 is a schematic view of a padlock according to a fifth embodiment of the present invention, showing that the padlock includes an indicative lock core capable of being operated by either a first key or a second key.
Figure 34:
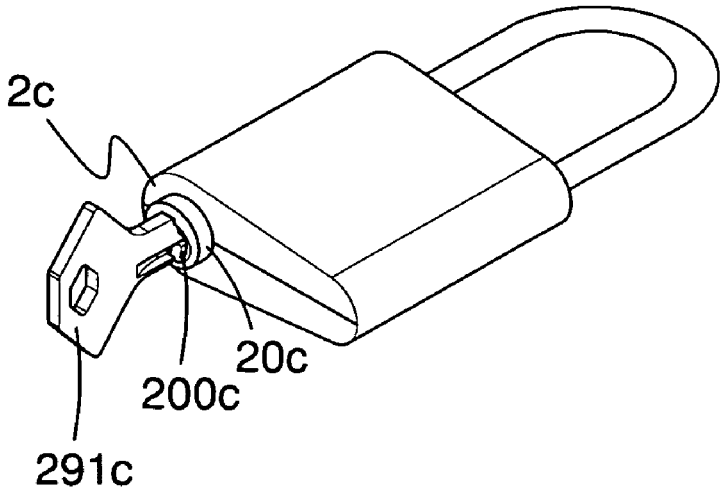
FIG. 34 is similar to FIG. 33, showing that the indicative lock core is partly exposed outside the housing by operation of the second key.

FIGS. 33 to 34 illustrate a padlock in accordance with a fifth embodiment of the present invention. The fifth embodiment excludes the above-mentioned combination lock core 7. Rather, the fifth embodiment includes a special key-operated lock core 2*c*. The spindle 20*c* of the key-operated lock core 2*c* of the present embodiment has an unusual keyhole 200*c* capable of receiving either a first key 290*c* or a second key 291*c*. In other words, either one of the first key 290*c* and the second key 291*c* can be used, independent of one another, to actuate the key-operated lock core 2*c* in order to lock or unlock the padlock. The second key 291*c* further controls whether the spindle 20*c* is allowed to move to the indicative position.

In the fifth embodiment, the spindle 20*c* is constructed to move to the indicative position under one of the three following situations. In one example, the spindle 20*c* may be constructed to move to the indicative position when the key 291*c* is inserted into the keyhole 200*c* of the spindle 20*c*. In another example, the spindle 20*c* may be constructed to move to the indicative position when the key 291*c* is inserted into the keyhole 200*c* of the spindle 20*c* and is operated to rotate the spindle 20*c* to an angle. In yet another example, the spindle 20*c* may be constructed to move to the indicative position when the key 291*c* is drawn out of the keyhole 200*c* of the spindle 20*c*.

From the foregoing description, the present invention relates to a padlock provided with the indicative lock core to indicate whether the indicative lock core has been operated by a key. This kind of indicative lock core is applied to many types of locks. More particularly, the indicative lock core can move to an indicative position where the indicative lock core is partly exposed outside the housing.

In any case, one would understand that the present invention contains industrial applicability in view of the teachings of the foregoing description. Further, the present invention contains novelty because no prior art has been found to be the same with the present invention. Still further, the present invention contains non-obviousness because no prior art has been found to be similar to the present invention. Accordingly, the present invention fulfills the requirements for a utility patent and is filed herein for application.

The invention claimed is:

1. A lock comprising:

a housing;

a shackle having a root section and a free section; said root section disposed in said housing; said free section extending from said root section;

a first lock core disposed in said housing and including a spindle capable of being driven to rotate by a key;

a controlling unit disposed in said housing, defining a locking hole in a top thereof to receive said root section of said shackle, and including a block and a driving member on a bottom thereof; and said controlling unit having one end connecting with said root section of said shackle and being capable of moving linearly with said root section of said shackle along an axis of said root section;

a second lock core disposed in said housing and including a movable part and a plurality of numeral wheels configured to control axial movement of said movable part;

wherein said driving member of said controlling unit is engaged with said spindle so that said controlling unit is able to rotate with said spindle simultaneously to either a locking position where said block of said controlling unit is obstructed by a distal end of said movable part for disabling said linear movement of said controlling unit with said shackle or an unlocking position where said block departs from said end of said movable part for enabling said linear movement of said controlling unit with said shackle.

2. The lock of claim 1, wherein said housing defines an opening; and said spindle is received inside said housing and exposed in said opening and is able to move by operation of said key to an indicative position where said spindle is partly situated outside said opening of said housing.

* * * * *